US008051770B2

(12) United States Patent
Song

(10) Patent No.: US 8,051,770 B2
(45) Date of Patent: Nov. 8, 2011

(54) ROBOT BINDING APPARATUS FOR COIL PACKAGING

(75) Inventor: Seung Yong Song, Jeollanam-do (KR)

(73) Assignee: Posco M-Tech, Pohang (KR)

( * ) Notice: Subject to any disclaimer, the term of this patent is extended or adjusted under 35 U.S.C. 154(b) by 359 days.

(21) Appl. No.: 12/351,499

(22) Filed: Jan. 9, 2009

(65) Prior Publication Data

US 2009/0308268 A1 Dec. 17, 2009

(30) Foreign Application Priority Data

Jun. 11, 2008 (KR) ..... 10-2008-0054494
Oct. 1, 2008 (KR) ..... 10-2008-0096469
Dec. 22, 2008 (KR) ..... 10-2008-0131270
Dec. 22, 2008 (KR) ..... 10-2008-0131271

(51) Int. Cl.
*B65B 13/04* (2006.01)
*B65B 27/06* (2006.01)

(52) U.S. Cl. ..... 100/12; 100/29; 100/33 R

(58) Field of Classification Search ..... 100/5, 8, 100/12, 16, 27, 29, 32, 33 R, 33 PB; 53/409, 53/204, 582, 589
See application file for complete search history.

(56) References Cited

U.S. PATENT DOCUMENTS 3,315,592 A * 4/1967 Lems ..... 100/3
3,331,312 A * 7/1967 Leslie et al. ..... 100/28
3,377,944 A * 4/1968 Hill ..... 100/7
3,379,121 A * 4/1968 Lems ..... 100/2
4,153,499 A * 5/1979 Annis ..... 156/494
4,829,753 A * 5/1989 Bricmont ..... 53/588
5,540,142 A * 7/1996 Mieleszuk et al. ..... 100/4
2004/0040451 A1* 3/2004 Peroni et al. ..... 100/5

FOREIGN PATENT DOCUMENTS

CN 1490219 4/2004
CN 1541897 11/2004
KR 102007007234 10/2006

OTHER PUBLICATIONS

Chinese Office Action for Chinese Application No. 200910000951.8, dated Dec. 24, 2010.

* cited by examiner

*Primary Examiner* — Jimmy T Nguyen
(74) *Attorney, Agent, or Firm* — Occhiuti Rohlicek & Tsao LLP

(57) ABSTRACT

A robot binding apparatus for coil packaging includes: a grip unit that grips a band used for packaging a coil; a grip robot that supports the grip unit, rotates the grip unit seizing the band at the periphery of the coil to make the band wound on the coil, and moves the band to a fastening position; a head unit that provides the band to the grip unit and fastens the band at the band fastening position; and a head robot that supports the head unit and moves the head unit to the band fastening position.

15 Claims, 20 Drawing Sheets

ROBOT BINDING APPARATUS FOR COIL PACKAGING

This application claims the benefit of priority of Korean Patent Application No. 10-2008-0054494 filed on Jun. 11, 2008, Korean Patent Application No. 10-2008-0096469 filed on Oct. 1, 2008, Korean Patent Application No. 10-2008-0131270 filed on Dec. 22, 2008 and Korean Patent Application No. 10-2008-0131271 filed on Dec. 22, 2008, which is incorporated by reference in its entirety herein.

BACKGROUND OF THE INVENTION

1. Field of the Invention

The present invention relates to a robot binding apparatus for coil packaging and, more particularly, to a robot binding apparatus for coil packaging to fix a packaging material to a coil.

2. Description of the Related Art

An iron manufacturing process includes an iron making process for producing a metallic stain (rusty water) by using key materials such as various iron ores, etc., a steelmaking process for producing a molten steel by removing impurities from the metallic stain, a continuous casting process for making the molten steel in the liquid state solid, and a rolling process for changing the solid steel into steel plates or wire rods, or the like.

The continuous casting process is a process whereby the molten steel in the liquid state is injected into a mold and allowed to pass through a continuous casting machine so as to be cooled and solidified into a semifinished product such as continuous slab, billet, or bloom. Of them, the slab is allowed to pass through a plurality of rotating rolls in the rolling process so as to be produced in the form of a thin steel plate. The thusly produced steel plate is wound in the form of coil for the sake of distribution and provided.

FIG. 1 is an exploded perspective view showing a coupling relationship between a coil and coil packaging materials. With reference to FIG. 1, the steel plate (referred to as 'coil', hereinafter) is wound in the form of coil and its inner and outer circumferential surfaces are packaged with packaging materials including a rust-free paper 11 wound at inner and outer circumferences of the coil 10 for moistureproofing, an outer circumference protection plate 12 for protecting the outer circumferential surface of the coil 10, an inner circumference protection plate 13 for protecting the inner circumferential surface of the coil 10, a section side plate 14 for protecting both sides of the coil 10, an inner circumference ring 15 for fixing the inner circumference protection plate 11 to the inner circumferential surface of the coil 10, and an outer circumference ring 16 for fixing the outer circumference protection plate 12 to the outer circumferential surface of the coil 10.

After the inner and outer circumferential surfaces of the coil 10 are packaged with the packaging materials, a binding process is performed to cover the inner and outer circumferential surfaces of the coil 10 to prevent the coil 10 from getting loosed and to bind the packaging materials.

However, as for the related art coil binding apparatus, an apparatus for conveying the coil 10, an apparatus for lifting the coil 10, and apparatuses disposed respectively in the direction that a band is wound on the coil 10 are separately disposed and operated.

As a result, the related art coil binding apparatus has a problem in that the space operation for the coil binding process is ineffective and the costs for initial investment in plant and equipment increase.

In addition, the area occupied by the devices and structures in use for the coil packaging hinders securing of a movement path and a working space for workers or operators, causing a problem that the workers may be exposed to an accident.

SUMMARY OF THE INVENTION

An object of the present invention is to provide a robot binding apparatus for coil packaging using a robot.

To achieve the above objects, there is provided a robot binding apparatus for coil packaging, including: a grip unit that grips a band used for packaging a coil; a grip robot that supports the grip unit, rotates the grip unit seizing the band at the periphery of the coil to make the band wound on the coil, and moves the band to a fastening position; a head unit that provides the band to the grip unit and fastens the band at the band fastening position; and a head robot that supports the head unit and moves the head unit to the band fastening position.

The robot binding apparatus for coil packaging according to the present invention is advantageous in that because the size of the apparatus used for the binding process for coil packaging is reduced, the space for the process can be effectively utilized and the costs for initial investment in plant and equipment can be reduced.

In addition, because the area taken by the structures for use in the coil packaging is reduced, the movement path and working space of workers can be secured and thus the possible occurrence of a safety accident can be prevented.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

The robot binding apparatus for coil packaging according to exemplary embodiments of the present invention will now be described with reference to the accompanying drawings.

Figure 1:
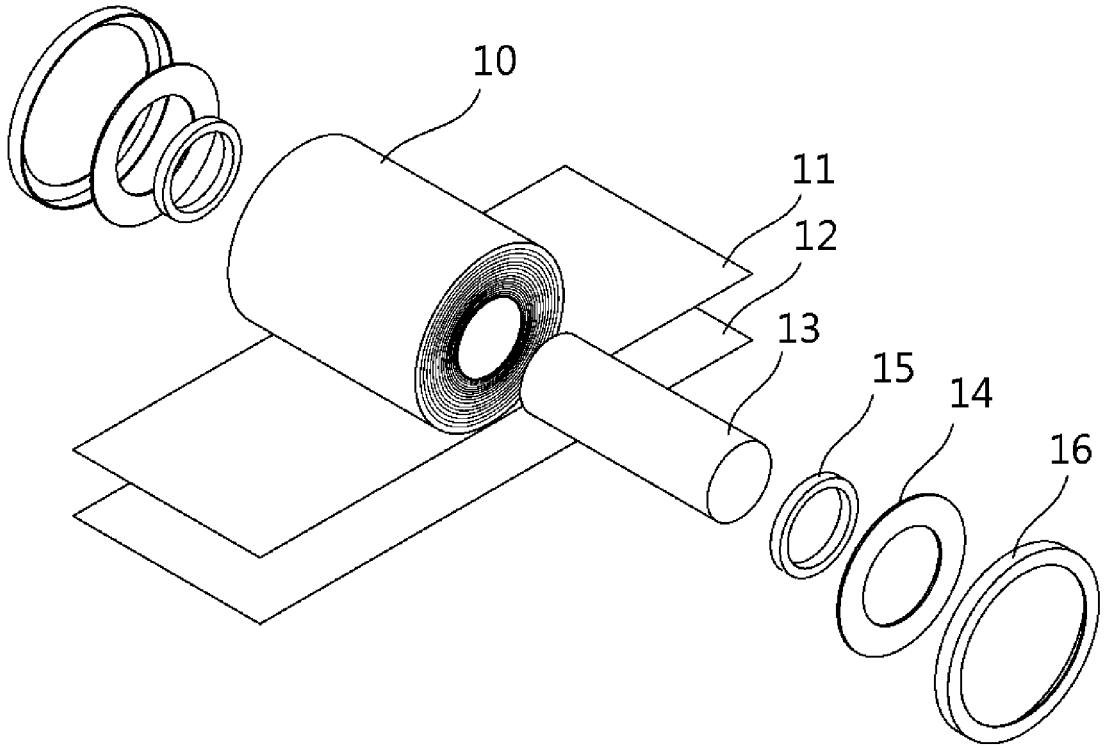
FIG. 1 is an exploded perspective view showing a coupling relationship between a coil and coil packaging materials.
Figure 2:
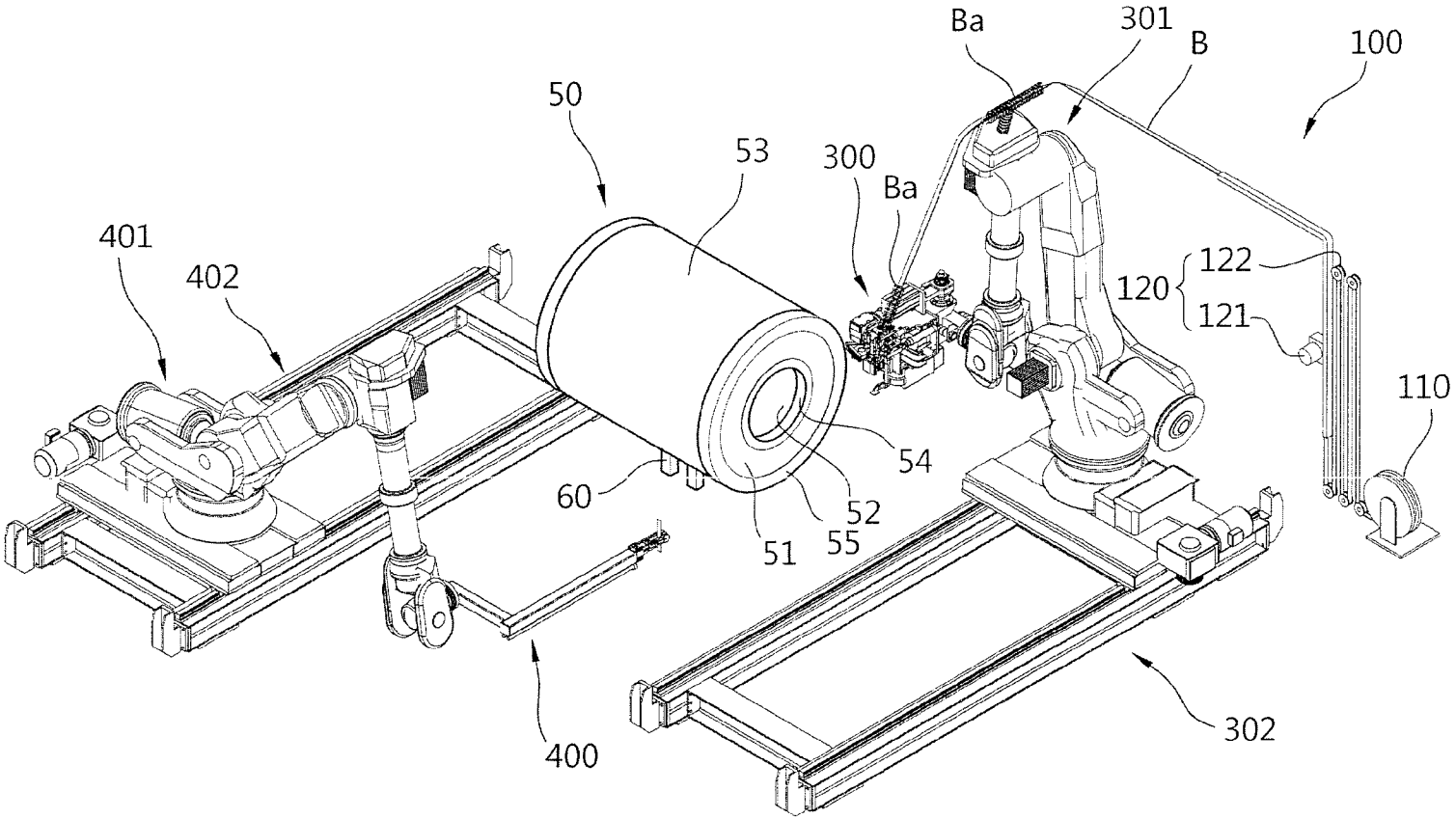
FIG. 2 is a perspective view showing a robot binding apparatus for coil packaging according to one embodiment of the present invention.

FIG. 2 is a perspective view showing a robot binding apparatus for coil packaging according to one embodiment of the present invention. With reference to FIG. 2, the robot binding apparatus includes a band supplier 100, a head unit 300, a head robot 301, a grip unit 400, a grip robot 401, and first and second robot transfer units 302 and 402.

The band supplier 100 includes a band storage unit 110 having a band (B) used for packaging a coil 50 and wound thereon, and a band auxiliary withdrawal unit 120 for withdrawing the band (B) from the band storage unit 110.

The band auxiliary withdrawal unit 120 includes a withdrawal motor 121 for withdrawing the band (B) of the band storage unit 110, and a plurality of withdrawal rollers 122 having the band (B) wound thereon, the band (B) with a reduced tension after it has been withdrawn from the withdrawal motor 121. The band auxiliary withdrawal unit 120 previously withdraws the band (B) wound on the band storage unit 110 to reduce the tension of the band (B), the band (B) can be smoothly supplied.

The head unit 300 receives the band (B) from the band supplier 100 and discharges a front end of the band (B). The grip unit 400 grips a front end of the band (B) discharged from the head unit 300. The head robot 301 and the grip robot 401 are provided as joint type robots having the degree of freedom of six axes.

The first and second robot transfer units 302 and 402 support the head unit 300 and the grip unit 400, respectively. The first and second robot transfer units 302 and 402 linearly transfer the head robot 301 and the grip robot 401. The first and second robot transfer units 302 and 402 may be implemented as one of a linear actuator including a power motor and a rack/pinion, a linear actuator including a linear motion (LM) motor and an LM guide, and a linear actuator including a power motor, a transfer rail, and a ball screw.

The head robot 301 and the grip robot 401 are linearly transferred by the first and second robot transfer units 302 and 402 to implement the degree of freedom of seven axes.

A coil support 60 is disposed between the head robot 301 and the grip robot 401. The coil support 60 supports the coil 50 packaged by a rust-free paper (not shown), section side plates 51, an inner circumference protection plate 52, an outer circumference protection plat 53, an inner circumference ring 54, and an outer circumference ring 55. The coil support 60 supports the coil 50 such that the coil 50 is separated from the ground.

A supply guide Ba is coupled (combined) with the head unit 300 and the head robot 301 and supports the band (B) supplied from the band supplier 100 to the head unit 300. Preferably, the supply guide Ba is an elastic body that can be deformed according to a change in the posture of the head robot 301. The supply guide Ba serves to prevent the band (B) from entwining with the head robot 301 and the head unit 300, when the band (B) is supplied to the head unit 300.

The operation of the robot binding apparatus according to the embodiment of the present invention will now be described briefly.

The band (B) wound at the band storage unit 110 is withdrawn from the band storage unit 110 by the band auxiliary withdrawal unit 120. The band (B) is wound in a tension-reduced state on the plurality of withdrawal rollers 122. The Band (B) wound on the plurality of withdrawal rollers 122 are supplied to the head unit 300.

The head unit 300 allows the front end of the band (B) to pass therethrough so as to be discharged outwardly. The grip unit 400 grips the front end of the band (B) which has been discharged out of the head unit 300. The grip robot 401 rotates the grip unit 400 at the periphery of the coil 50 supported by the coil support 60. Then, the head robot 301 moves the head unit 300 to a fastening position of the band (B). The band (B) is drawn out through the head unit 300 by the trip robot 401, and then wound on the inner and outer circumferential surfaces of the coil 50 supported by the coil support 60.

When the band (B) is wound on the coil 50, the grip robot 401 moves the front end of the band (B) to the fastening position. The head unit 300 transfers the band (B) thereinto so that the bands (B) can overlap each other within the head unit 300. The head unit 300 fixes the front end of the band (B) to firmly wind the band (B) wound on the coil 50, and rewinds the band (B). The head unit 300 fastens the overlapping bands (B), and cuts off a portion next to the fastened portion of the bands (B).

In this manner, the robot binding apparatus winds the bands (B) on the inner and outer circumferences of the coil 50 and fastens the bands (B) to bind the packaging materials 51, 52, 53, 54, and 55 to the coil 50.

The configuration and operation of the robot binding apparatus according to the embodiment of the present invention will now be described in more detail with reference to the accompanying drawings.

Figure 3:
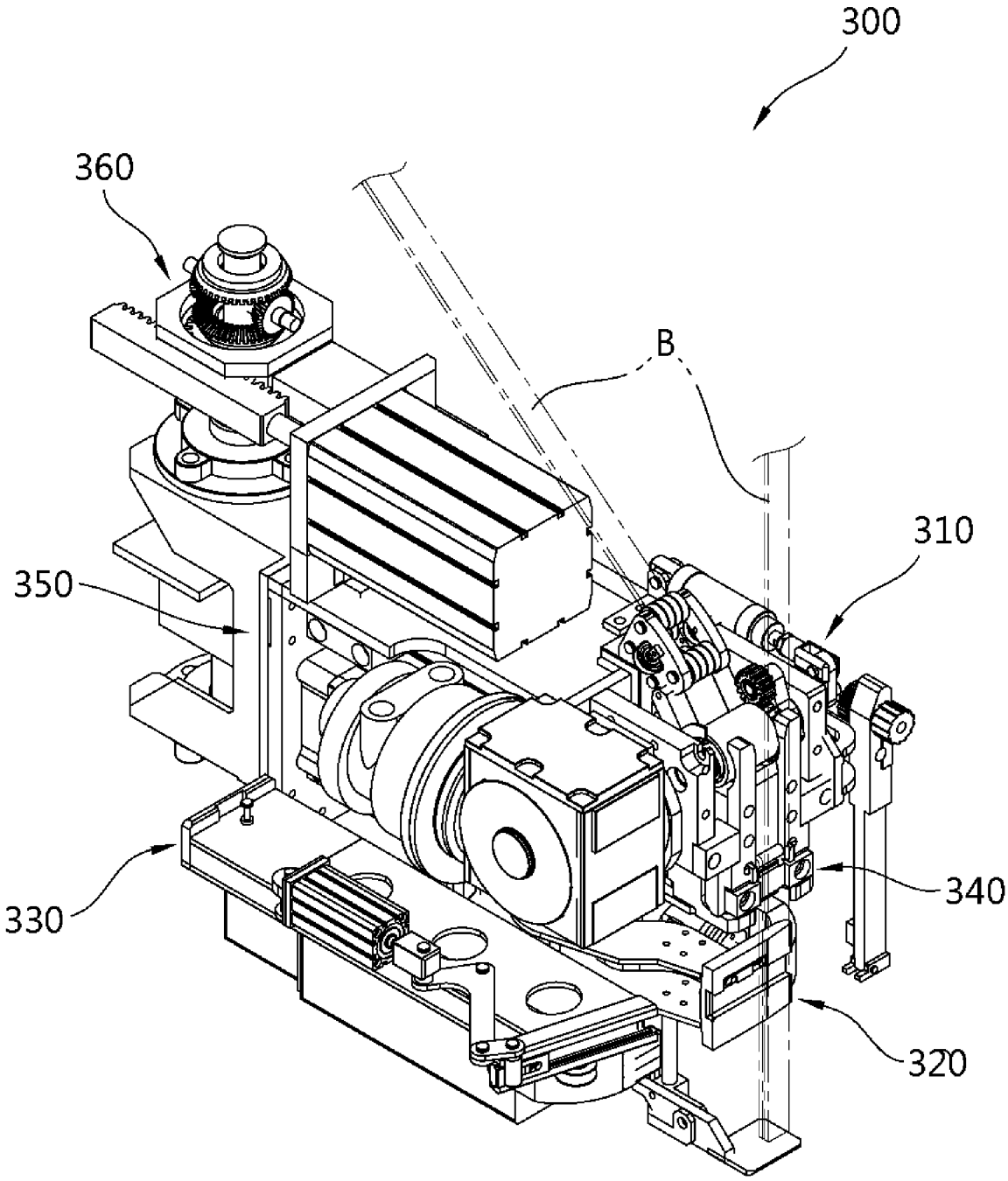
FIG. 3 is a perspective view showing a head unit of the robot binding apparatus for coil packaging according to one embodiment of the present invention.
Figure 4:
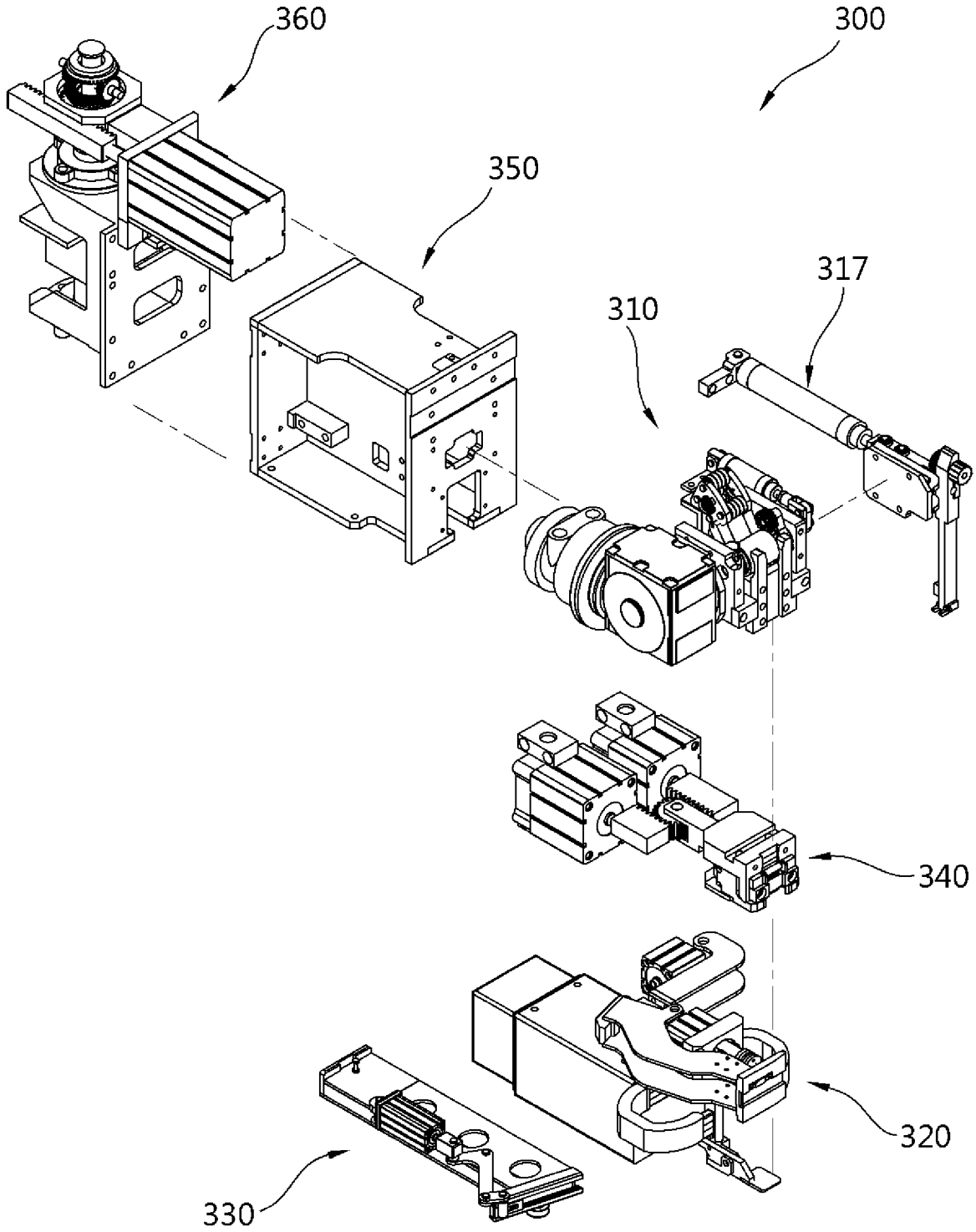
FIG. 4 is an exploded perspective view showing the head unit of the robot binding apparatus for coil packaging according to one embodiment of the present invention.

FIG. 3 is a perspective view showing the head unit of the robot binding apparatus for coil packaging according to one embodiment of the present invention, and FIG. 4 is an exploded perspective view showing the head unit of the robot binding apparatus for coil packaging according to one embodiment of the present invention. With reference to FIGS. 3 and 4, the head unit 300 includes a band transfer unit 310, a band fastening unit 320, a pad supply unit 330, a band cutting unit 340, and a bracket 350 supporting the band cutting unit. A rotating unit 360 is disposed between the bracket 350 and a rotating end portion of the head robot 301 to allow the bracket 350 to be rotated from the rotating end portion of the head robot 301.

The band transfer unit 310 transfers the band (B) supplied from the band supplier 100 and outwardly discharges the front end of the band (B) out of the head unit 300. In addition, the band transfer unit 310 transfers the front end of the band (B), which is re-inserted into the head unit 300 after being wound on the coil 50, to the band fastening unit 320. In addition, the band transfer unit 310 rewinds the band (B) to firmly wind the band (B) wound on the coil 50.

When the head unit 300 is moved to the fastening position by the head robot 301, the pad supply unit 330 supplies a pad to the band fastening unit 320.

The band fastening unit 320 attaches the pad on the outer circumferential surface of the coil 50 before fastening the bands (B). In addition, the band fastening unit 320 melts (fuses) the overlapping bands (B) to fasten them.

The band cutting unit 340 fixes the front end of the band (B) which has been re-inserted into the head unit 300 so that the band (B) can be re-wound. After the band (B) is fastened, the band cutting unit 340 cuts off a portion next to the fastened portion of the band (B).

Figure 5:
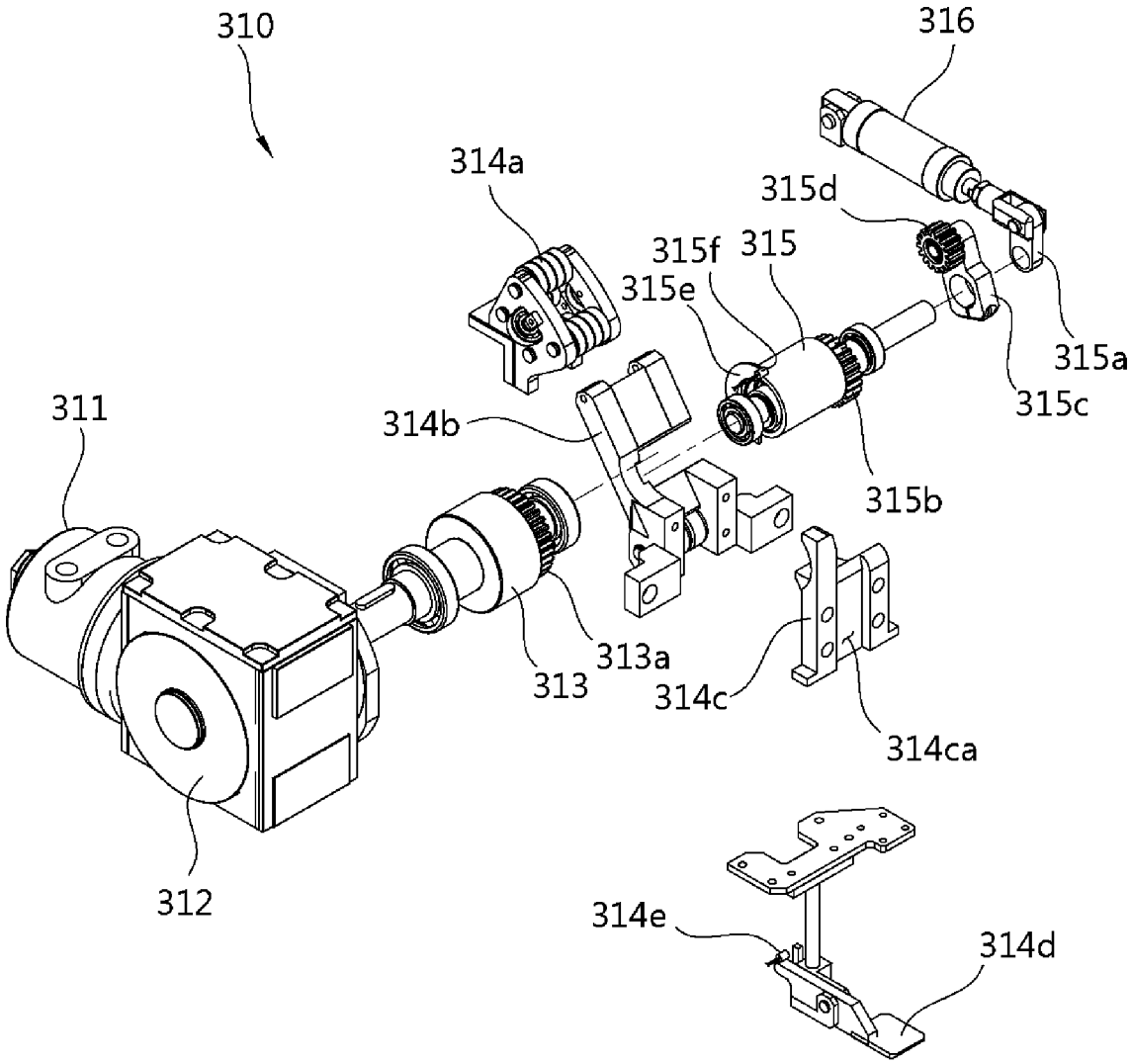
FIG. 5 is an exploded perspective view showing a band transfer unit of the head unit of the robot binding apparatus for coil packaging according to one embodiment of the present invention.

FIG. 5 is an exploded perspective view showing the band transfer unit of the head unit of the robot binding apparatus for coil packaging according to one embodiment of the present invention. With reference to FIGS. 3 to 5, the band transfer unit 310 includes a driving motor 311 providing rotatory power, an accelerator/decelerator 312 coupled with a rotational shaft of the driving motor 311, and a transfer roller 313 coupled with a rotational shaft of the accelerator/decelerator 312.

The band transfer unit 310 includes a plurality of guide rollers 314*a* disposed at a path of the band (B) supplied from the band supplier 100, a first band guide 314*b* disposed at a lower side of the plurality of guide rollers 341*a* and extending to the band cutting unit 340, a second band guide 314*c* disposed at an outer side of the first band guide 314*b*, and a band stopper 314*d* disposed at a lower side of the band fastening unit 320.

Also, the band transfer unit includes a backup roller 315 disposed at an upper side of the transfer roller 313, a backup link 315*a* coupled with a rotational shaft of the backup roller 315, and a backup cylinder 316 coupled with the backup link 315*a*. The band transfer unit 310 further includes a first output gear 313*a* coupled with the rotational shaft of the accelerator/decelerator 312 and a first input gear 315*b* coupled with the rotational shaft of the backup roller 315.

The backup link 315*a* is rotated by the backup cylinder 316, and the backup roller 315 is moved by the backup link 315*a* to come in contact with the transfer roller 313. At this time, the first input gear 315*b* is engaged with the first output gear 313*b*.

The operation of transferring the band (B) by the head unit 300 will now be described.

The band (B) supplied from the band supplier 100 goes toward the transfer roller 313, while being supported by the plurality of guide rollers 314*a*. The plurality of guide rollers 314*a* support the band (B) up and down and left and right to thereby prevent the band (B) from being twisted. Passing through the plurality of guide rollers 314*a*, the band (B) is guided to the transfer roller 313 along the first band guide 314*b*.

The driving motor 311 is rotated forwardly to transfer the band (B), and the accelerator/decelerator 312 accelerates/decelerates the rotation speed of the driving motor 311 to rotate the transfer roller 313. At this time, the backup roller 315 comes in contact with the transfer roller 313, and the first input gear 315*b* is engaged with the first output gear 313*a*. The backup roller 315 receives the rotatory power by the first input gear 315*b* from the first output gear 313*a* and is rotated in the reverse direction of the rotation direction of the transfer roller 313.

The band (B) is transferred in contact with the transfer roller and the backup roller 315, and passes between the first band guide 314*b* and the second band guide 314*c*. The front end of the band (B) passes through the band cutting unit 340 and the band fastening unit 320 to reach the band stopper 314*d*. The band stopper 314*d* prevents the band (B) from proceeding, so the front end of the band (B) is positioned on the band stopper 314*d*.

Here, the band stopper 314*d* is provided to be rotated when the front end of the band (B) contacts therewith. A position detector 314*e* is disposed at a rotary end portion of the band stopper 314*d* to detect rotation of the band stopper 314*d*. As the band stopper 314*d* is rotated, the position detector 314*e* comes in contact with the rotary end portion of the band stopper 314*d* to generate a contact signal.

When the front end of the band (B) is positioned at the band stopper 314*d*, the grip unit 400 grips the front end of the band (B) and the grip robot 401 rotates the grip unit 400 at the periphery of the coil 50. At this time, the backup cylinder 316 rotates the backup link 315*a*. According to the rotation of the backup link 315*a*, the backup roller 315 is separated from the transfer roller 313 so the band (B) passing between the backup roller 315 and the transfer roller 313 is smoothly drawn out.

Meanwhile, the grip robot 401 moves the band (B) to the fastening position. The front end of the band (B) is inserted to an outer side of the second band guide 314*c*. The front end of the band (B) is received in a first band receiving recess 314*ca* formed at the outer side of the second band guide 314*c*. The front end of the band (B) reaches the band stopper 314*d* by a pressing transfer roller 317*h* (See FIG. 6) of a pressing transfer unit 317 (to be described).

As the front end of the band (B) comes in contact with the band stopper 314*d*, the band stopper 314*d* is rotated to generate a contact signal and the driving motor 311 is reversely rotated. According to the generation of the contact signal, the backup cylinder 316 rotates the backup link 315*a*. According to the rotation of the backup link 315*a*, the backup roller 315 is moved toward the transfer roller 313 and the first input gear 315*b* is engaged with the first output gear 313*a*. At this time, the band cutting unit 340 fixes the front end of the band (B) and the band (B) supplied from the band supplier 100 is positioned between the backup roller 315 and the transfer roller 313.

According to the reverse rotation of the driving motor 311, the accelerator/decelerator 314 accelerates/decelerates the rotation speed of the driving motor 311 to reversely rotate the transfer roller 313. At this time, the backup roller 315 is rotated in the reverse direction of the rotation direction of the transfer roller 313 upon receiving the rotatory power by the first input gear 315*b* in mesh with the first output gear 313*a*.

The band (B) is in contact with the transfer roller 313 and the backup roller 315 and re-wound, and the tension of the band (B) wound on the coil 50 is increased.

A step 315*e* is formed to be protruded from one portion of an outer diameter of the side of the backup roller 315, and a tension detector 315*f* is disposed at the side portion of the backup roller 315 where the step 315*e* is formed, to detect rotation of the step 315*e* according to the rotation of the backup roller 315. The rotation speed of the backup roller 315 is in inverse proportion to the tension of the band (B). Namely, as the tension of the band (B) is increased, the rotation speed of the backup roller 315 is gradually reduced. Thereafter, when the tension of the band (B) becomes the same as (as strong as) the rotatory power of the driving motor 311, the backup roller 315 is not rotated any longer. With the backup roller 315 not rotated, the contact signal is maintained at or is not generated from the tension detector 315*f*.

When the contact signal of the tension detector 315*f* is maintained for a certain period of time or when no contact signal is generated for the certain period of time, the reverse rotation of the driving motor 311 is stopped and the rewinding of the band (B) is terminated.

The band transfer unit 310 further includes a gear link 315*c* coupled with the rotational shaft of the backup roller 315 and a second output gear 315*d* coupled with the gear link 315*c*. In addition, the band transfer unit 310 further includes the pressing transfer unit 317 disposed at one side of the second band guide 314*c* and protracted from or retracted to a front face of the first band receiving recess 314*ca* to open an close the first band receiving recess 314*ca*.

Figure 6:
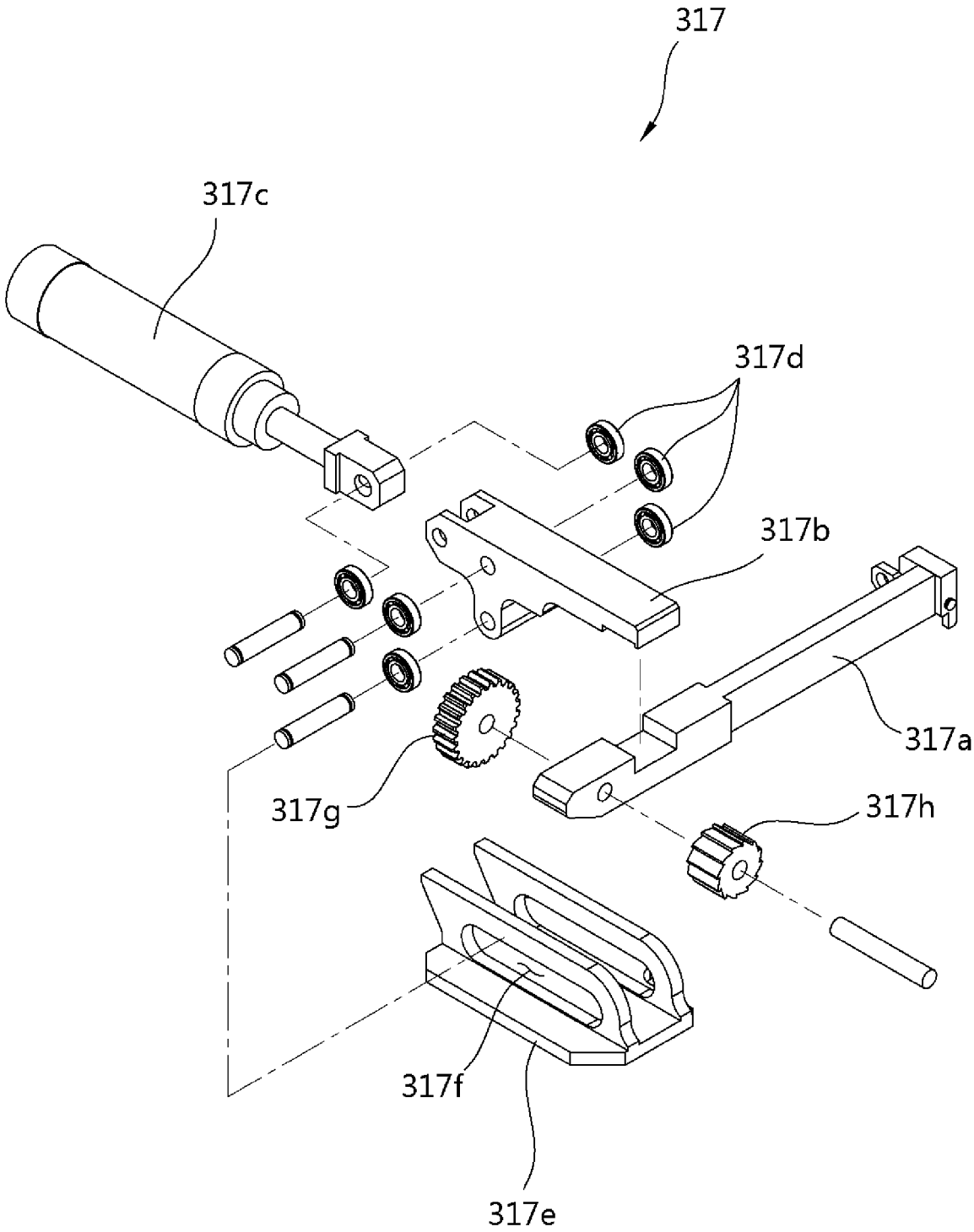
FIG. 6 is an exploded perspective view showing a pressing transfer unit of the head unit of the robot binding apparatus for coil packaging according to one embodiment of the present invention.

FIG. 6 is an exploded perspective view showing the pressing transfer unit of the head unit of the robot binding apparatus for coil packaging according to one embodiment of the present invention. With reference to FIG. 6, the pressing transfer unit 317 includes an opening/closing bar 317*a* disposed at one side thereof. An opening/closing link 317*b* is coupled with a certain portion of the opening/closing bar 317*a*, and an opening/closing cylinder 317*c* is coupled with the opening/closing link 317*b*.

The pressing transfer unit 317 further includes a plurality of opening/closing rollers 317*d* coupled with both sides of the opening/closing link 317*b* and an opening/closing rail 317*e* that forms a movement path of the plurality of opening/closing rollers 317*d*. The opening/closing rail 317*e* includes an opening/closing guide hole 317*f* formed to be long therein to restrain one of the plurality of opening/closing rollers 317*d* and limits a movement distance of the opening/closing roller 317*d*. The opening/closing rail 317*e* includes a straight line section corresponding to the opening/closing guide hole 317*f* and a curved line section coaxial with the opening/closing guide hole 317*f*.

The pressing transfer unit 317 includes a second input gear 317*g* coupled with the opening/closing bar 317*a* and the pressing transfer roller 317*h* coupled with a rotational shaft of the second input gear 317*g*.

The operation of opening/closing the band (B) by head unit 300 will now be described.

As described above, the front end of the band (B) re-inserted into the head unit 300 by the grip unit 400 and the grip robot 401 is inserted into the first band receiving recess 314*ca* formed at an outer side of the second band guide 314*c*. At this time, the opening/closing cylinder 317*c* advances the opening/closing link 317*b* in order to prevent the band (B) from being released from the first band receiving recess 314*ca*.

As the opening/closing cylinder 317*c* advances the opening/closing link 317*b*, the plurality of opening/closing rollers 317*d* are moved along the straight line section of the opening/closing rail 317*e*. The opening/closing roller 317*d* restrained in the opening/closing guide hole 317*f* is stopped at an end portion of the opening/closing guide hole 317*f*, while the other remaining opening/closing rollers 317*d* are further moved along the curved line section of the opening/closing rail 317*e*. Accordingly, the opening/closing link 317*b* is rotated toward the first band receiving recess 314*ca* by using the opening/closing roller 317*d* limited in its movement at the end portion of the opening/closing guide hole 317*f* as a rotational shaft. The opening/closing bar 317*a* is rotated according to the opening/closing link 317*b* to close the first band receiving recess 314*ca*.

At this time, the pressing transfer roller 317*h* presses the band (B) received in the first band receiving recess 314*ca*, and the second input gear 317*g* is engaged with the second output gear 315*d*. The pressing transfer roller 317*h* is rotated upon receiving rotatory power by the second input gear 317*g* via the second output gear 315*d*, and transfers the band (B) to the band stopper 314*d*.

Figure 7:
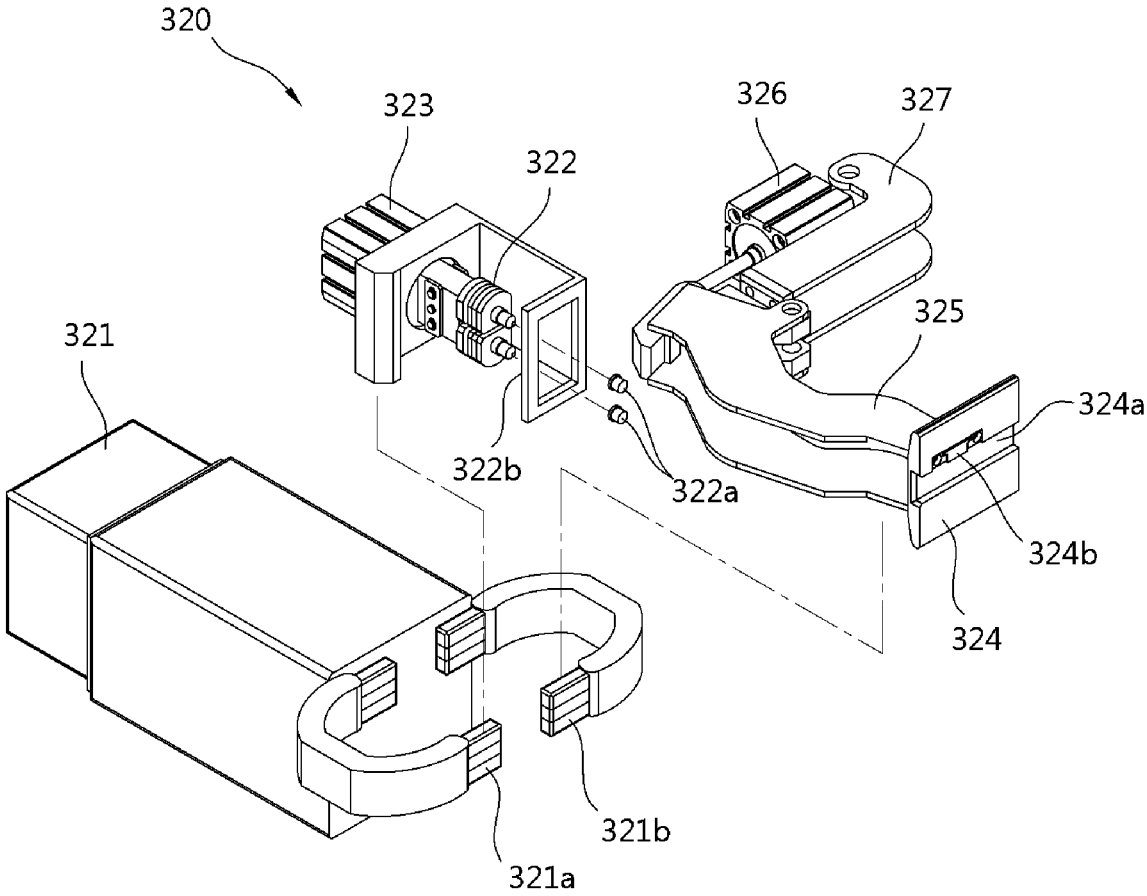
FIG. 7 is an exploded perspective view showing a band fastening unit of the head unit of the robot binding apparatus for coil packaging according to one embodiment of the present invention.

FIG. 7 is an exploded perspective view showing a band fastening unit of the head unit of the robot binding apparatus for coil packaging according to one embodiment of the present invention. With reference to FIG. 7, the band fastening unit 320 includes a power supplier 321 that supplies power required for welding the overlapping bands (B). First and second electrode bars 321*a* and 321*b* are connected with the power supplier 321. A welding gun 322 with welding tips 322*a* are coupled with the first electrode bar 321*a*, and a support panel 324 is connected with the second electrode bar 321*b*. The welding gun 322 is provided to move forward and backward by a welding cylinder 323.

The operation of fastening the band (B) by the head unit 300 will now be described.

As described above, when the front end of the band (B) is re-inserted into the head unit 300 and the front end of the band (B) is transferred up to the band stopper 314*d* by the pressing transfer roller 317*h*, the bands (B) overlap at the band fastening unit 320. At this time, the welding gun 322 is positioned at an inner side of the overlapping bands (B), and the support panel 324 is positioned at an outer side of the overlapping bands (B).

The power supplier 321 supplies power to the first and second electrode bars 321*b*. The first electrode bar 321*a* provides power to the welding gun 322, and the second electrode bar 321*b* provides power to the support panel 24. The welding cylinder 323 advances the welding gun 322. As the welding gun 322 moves forward, the welding tips 322*a* press the inner side of the overlapping bands (B), and the rear surface of the support panel 324 supports the outer side of the overlapping bands (B). Accordingly, the overlapping bands (B) are compressed, and the welding tips 322*a* and the support panel 324 are electrically conducted. According to the electrical conduction of the welding tips 322*a* and the support panel 324, the compressed bands (B) are heated and molten to be fastened.

A separator 322*b* is disposed between the welding gun 322 and the fastened bands (B). The separator 322*b* serves to support the bands (B) while the welding gun 322 moves backward to thereby allow the welding tips 322*a* compressed to the bands (B) to be easily separated after the bands (B) are fastened.

Preferably, a plurality of the welding guns 322 and a plurality of the welding tips 322*a* are provided. The plurality of welding guns 322 and the plurality of welding tips 322*a* may simultaneously form welding points at a plurality of points of the compressed bands (B). Thus, a processing time required for fastening the bands (B) can be shortened and the bands (B) can be firmly fastened.

The band fastening unit 320 includes a panel bar 325 supporting the support panel 324, a panel cylinder 326 coupled with the panel bar 325, and a panel link 327 having one end portion hinge-combined with the panel bar 326 and the other end portion fixed to the panel cylinder 326.

The panel cylinder 326 advances the panel bar 325, and the panel bar 325 is rotated by using a hinge shaft of the panel line 327 as a rotation shaft. According to the rotation of the panel bar 325, the support panel 324 is rotated toward the pad supply unit 330 from the fastening position.

The rotational operation of the support panel 324 is to transfer the pad supplied from the pad supply unit 330 to between the coil 50 and the band (B). Thus, a pad receiving recess 324*a* is formed on a front surface of the support panel 324 to receive the pad supplied from the pad supply unit 330, and a pad grip 324*b* is provided at an inner side of the pad receiving recess 324*a* to elastically support the pad.

Figure 8:
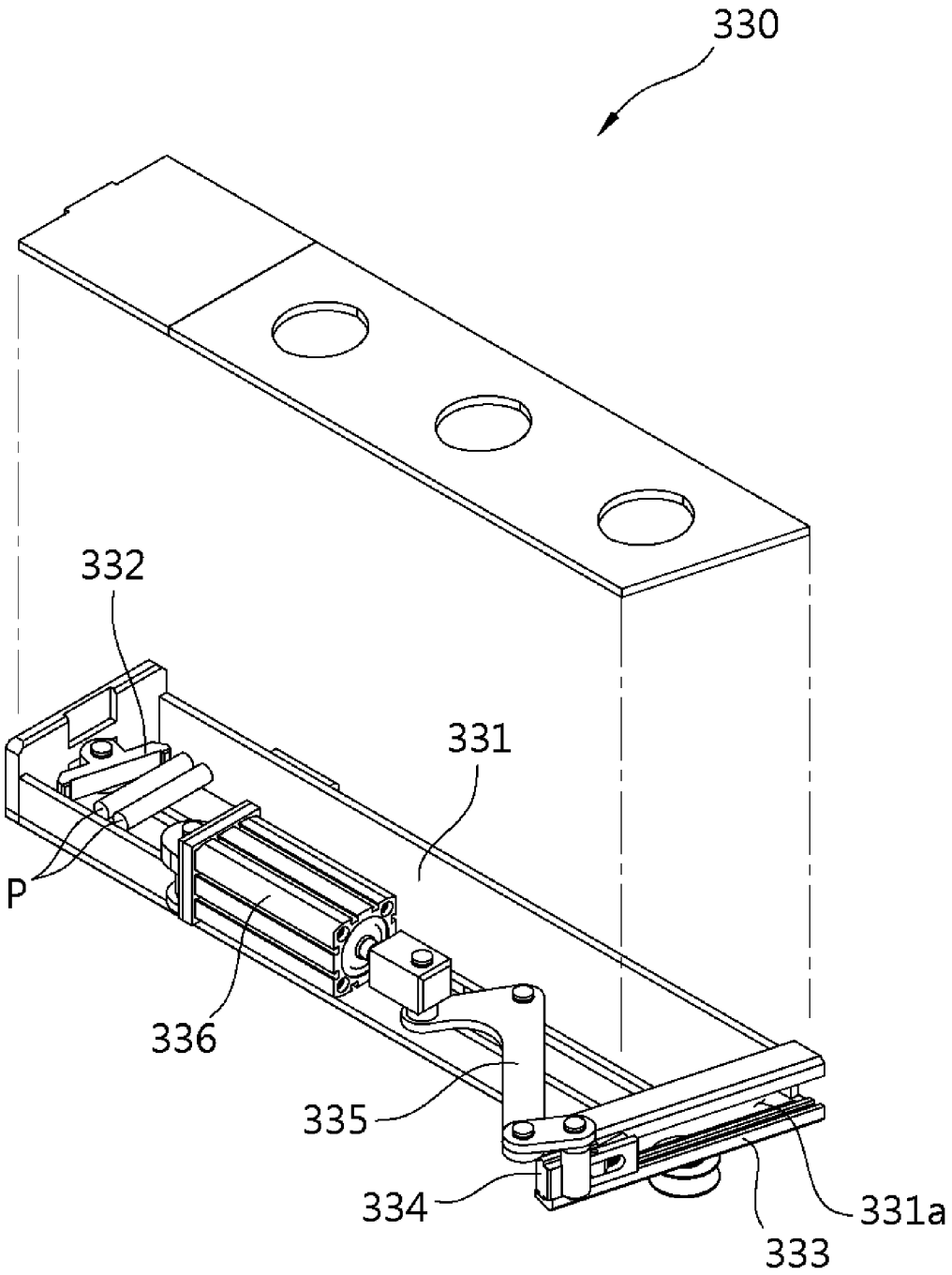
FIG. 8 is an exploded perspective view showing a pad supply unit of the head unit of the robot binding apparatus for coil packaging according to one embodiment of the present invention.

FIG. 8 is an exploded perspective view showing the pad supply unit of the head unit of the robot binding apparatus for coil packaging according to one embodiment of the present invention. With reference to FIG. 8, the pads (P) includes a magnetic portion (or magnet) therein so as to be easily attached to the coil 50.

The pad supply unit 330 includes a pad repository 331 that forms a storage space of the plurality of pads (P), and an elastic support bar 332 for elastically supports the plurality of pads (P) stored in the pad repository 331. A discharge opening 331*a* is formed at a front side of the pad repository 331 to discharge the pads (P), and a pad guide 333 is disposed at an outer side of the discharge opening 331*a* to prevent the pads (P) elastically supported by the elastic support bar 332 from being released and form a supply path of the pads (P). A pad pressing bar 334 is provided at an inner side of the pad guide 333 and coupled with a pad link 335. The pad link 335 is hinge-combined with an output stage of the pad cylinder 336.

The operation of supplying the pads (P) by the head unit will now be described.

The pad cylinder 336 advances the pad link 335 to supply the pads (P). The pad link 335 is rotated by using the hinge shaft as a rotation shaft, and the pad pressing bar 334 presses the pads (P) waiting at the pad guide 333. The pads (P) are supplied from the pad guide 333 to the support panel 324. The pad (P) supplied to the support panel 324 is received in the pad receiving recess 324*a* and prevented from being released from the pad receiving recess 324*a* by the pad grip 324*b*.

When the pad (P) is received in the pad receiving recess 324*a*, the support panel 324 is rotated to the fastening position of the band (B). At this time, the front side of the support panel 324 approaches an outer circumferential surface of the coil 50, and the pad (P) including the magnetic portion is attached to the outer circumferential surface of the coil 50. Thereafter, as the band (B) wound on the coil 50 is rewound, the pad (P) is fixed between the coil 50 and the band (B).

After the band (B) is rewound, the pad (P) attached to the outer circumferential surface of the coil 50 forms some space between the outer circumferential surface of the coil 50. The space formed by the pad (P) provides a convenience allowing a user of the coil 50 to insert a dissection tool of the band (B).

Figure 9:
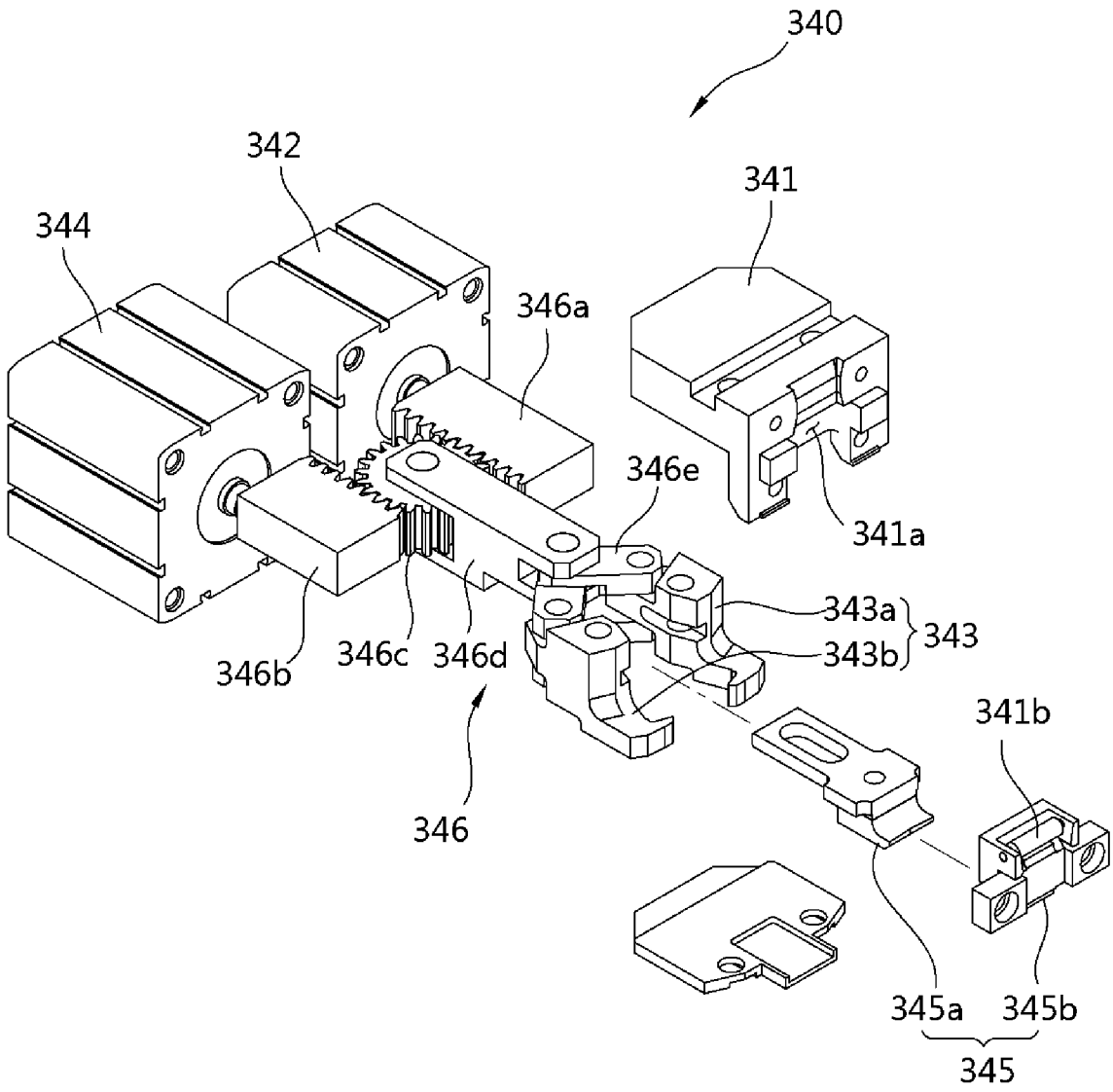
FIG. 9 is an exploded perspective view showing a band cutting unit of the head unit of the robot binding apparatus for coil packaging according to one embodiment of the present invention.

FIG. 9 is an exploded perspective view showing the band cutting unit of the head unit of the robot binding apparatus for coil packaging according to one embodiment of the present invention. As shown in FIG. 9, the band cutting unit 340 includes a guide block 341 disposed at a path of the band (B) transferred along the second band guide 314*c*. The guide block 341 includes a second band receiving recess 341*a* formed on a front side thereof.

In addition, the band cutting unit 340 includes a fixing cylinder that provides power required to fix the front end of the band (B) and a fixing unit 343 that fixes the band (B) by using the power provided by the fixing cylinder 342.

The band cutting unit 340 further includes a cutting cylinder 344 that provides power required for cutting the portion next to the fastened portions of the bands (B), and a cutting unit 345 that cuts the band (B) by using the power provided by the cutting cylinder 344.

Also, the band cutting unit 340 further includes a power transmitter 346 that transfers each power of the fixing cylinder 342 and the cutting cylinder 344 to the fixing unit 343 and the cutting unit 345.

The power transmitter 346 includes a fixed driving rack 346*a* coupled with an output stage of the fixing cylinder 342, a cutting driving rack 346*b* coupled with an output stage of the cutting cylinder 344, a pinion 346*c* engaged with the fixed driving rack 346*a* and the cutting driving rack 346*b*, a moving rink 346*d* coupled with a rotational shaft of the pinion 346*c*, and a pair of rotating links 346*e* coupled with a hinge shaft of the moving link 346*d*. The fixing unit 343 includes a pair of clamps 343*a* and 343*b* hinge-combined with the pair of rotating links 346*e*, respectively. The cutting unit 345 includes a transfer cutter 345*a* coupled with a hinge shaft of the moving link 346*d* and a fixed cutter 345*b* fixed to a lower end of the guide block. A support roller 341*b* is provided between the guide block 341 and the fixed cutter 345*b* to support the band (B) advancing toward the cutting unit 345.

The operation of fixing and cutting the bands (B) by the head unit 300 will now be described. As the band (B) is drawn out by the grip robot 401, a certain portion of the band (B) passes through between the first and second band guides 314*b* and 314*c* and then passes through a front side of the guide block 341, and the band (B) wound on the coil 50 is inserted into the second band receiving recess 341*a*, so that the bands (B) overlap from the guide block 341 to the band stopper 314*d*.

The fixing cylinder 342 advances the fixed driving rack 346*a* to fix the front end of the band (B). As the fixed driving rack 346*a* is advanced, the pinion 346*c* and the moving link 346*d* move forward. At this time, the transfer cutter 345*a* is advanced according to the advancing of the moving link 346*d* to press the inner side of the overlapping bands (B). As the inner side of the overlapping bands (B) are pressed, the inner one of the overlapping bands (B), namely, the front end of the band (B), is positioned within a rotation range of the pair of clamps 343*a* and 343*b*, while the outer one of the overlapping bands is positioned outside the rotation range of the pair of clamps 343*a* and 343*b*.

Subsequently, an included angle of the pair of rotating links 346*e* hinge-combined with the moving link 346*d* widens, while that of the pair of clamps 343*a* and 343*b* hinge-combined with the pair of rotating links 346*e* becomes narrow. The pair of clamps 343*a* and 343*b* presses the front end of the band (B) from both sides, fixing the front end of the band (B). With the front end of the band (B) fixed by the pair of clamps 343*a* and 343*b*, the band (B) can be rewound.

Thereafter, the cutting cylinder 344 advances the cutting driving rack 346*b* to cut off the portion next to the fastened portions of the bands (B). The pinion and the moving link are advanced according to the advancing of the cutting driving rack 346*b*. The transfer cutter coupled with the hinge shaft of the moving link moves forward, and cuts off the portion next to the fastened portion of the band in association with the fixed cutter.

Figure 10:
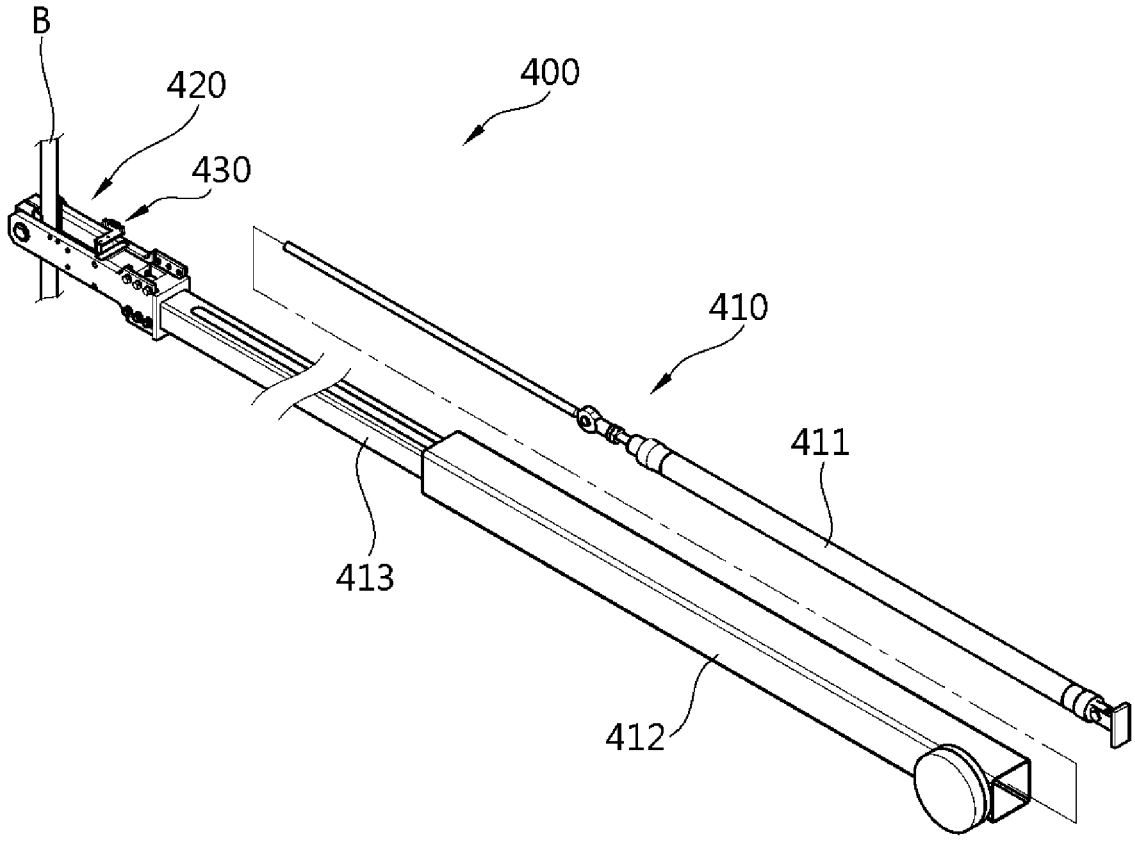
FIG. 10 is a perspective view showing a grip unit of the robot binding apparatus for coil packaging according to one embodiment of the present invention.

FIG. 10 is a perspective view showing the grip unit of the robot binding apparatus for coil packaging according to one embodiment of the present invention. With reference to FIG. 10, the grip unit 400 includes an elastic (expansive and contractive) part 410, a grip part 420, and a rotation controller 430. The elastic part 410 is hinge-combined with an end portion of the grip robot 401 such that it can be rotated. The grip part 420 is coupled with an end portion of the elastic part 410, and the rotation controller 430 is coupled with one side of the grip part 420.

The elastic part 410 includes an elastic cylinder 411 that provides power required for expanding and contracting the overall length, an outer frame 412 that supports the elastic cylinder 411, and an inner frame 413 coupled with an output stage of the elastic cylinder 411.

The elastic part 410 extends the grip unit 420 from the end portion of the grip robot 401 to allow the grip unit 420 to easily approach the front end of the band (B) discharged from the head unit 300. In addition, the elastic part 410 contacts the grip part 420 gripping the front end of the band (B) discharged from the head unit 300 toward the end portion of the grip robot 401 so as to draw out the band (B) from the head unit 300.

Figure 11:
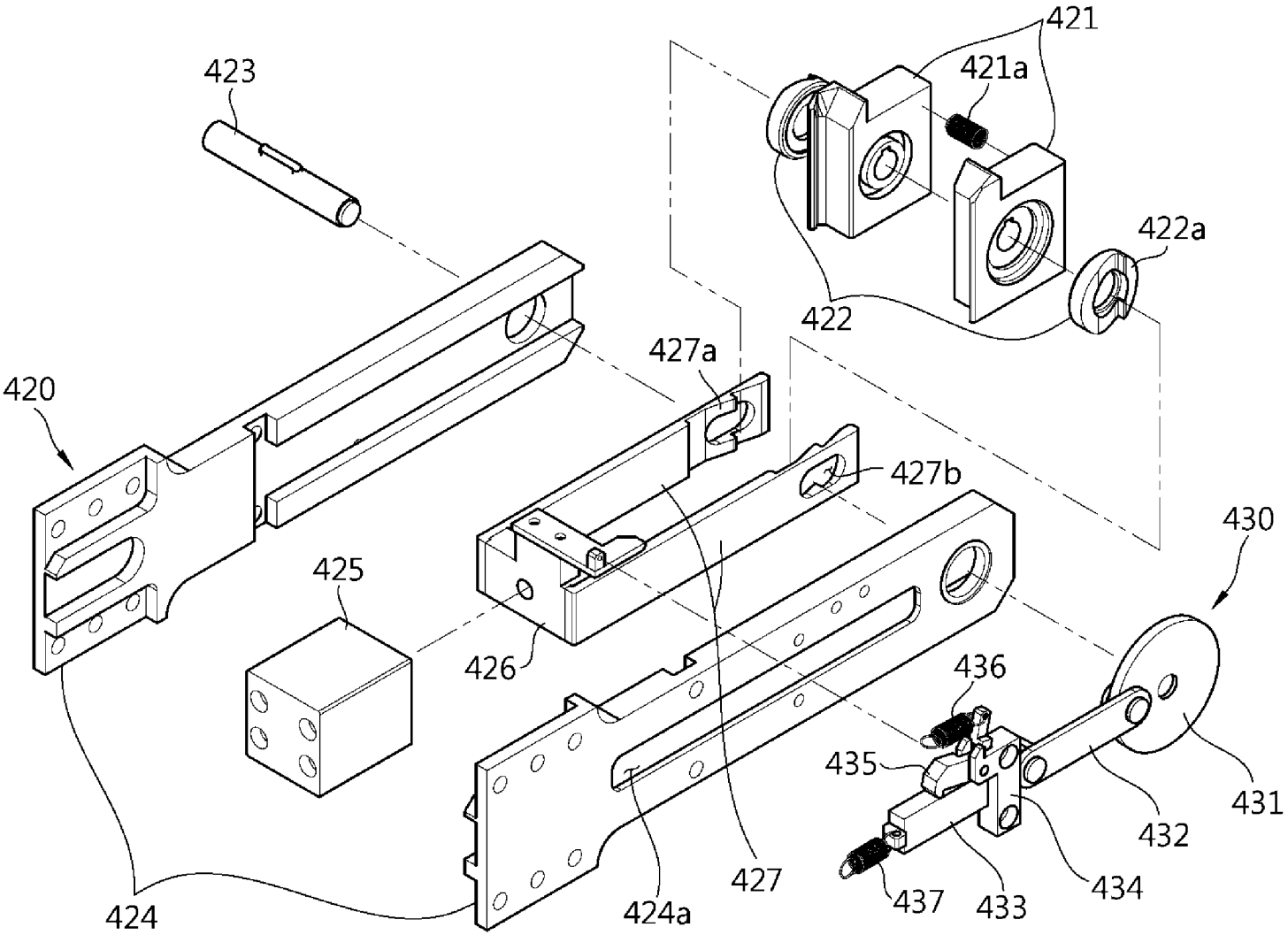
FIG. 11 is an exploded perspective view showing a grip part of the grip unit of the robot binding apparatus for coil packaging according to one embodiment of the present invention.

FIG. 11 is an exploded perspective view showing a grip part of the grip unit of the robot binding apparatus for coil packaging according to one embodiment of the present invention. With reference to FIG. 11, the grip part 420 includes a grip cylinder 425 coupled with an end portion of the inner frame 413. A pair of grip frames 424 are coupled with outer surfaces of the grip cylinder 425, and a rod block 426 coupled with an outer stage of the grip cylinder 425 and a pair of slide bars 427 coupled with outer sides of the rod block 426 are disposed at an inner side of the grip frame 424. A pair of grippers 421 are disposed between the pair of slide bars 427. An elastic member 421*a* is disposed between the pair of grippers 421. Grip supporters 422 are disposed between the slide bars 427 and the grippers 421.

The pair of grip supporters 422 are inserted and fixed at outer sides of the pair of grippers 421, and the pair of grippers 421 are axially combined with a grip rotational shaft 423 supported to be rotatable at the grip frames 424.

The pair of slide bars 427 include first irregular portion 427*a* formed at inner surfaces facing the grip supporter 422, and the pair of grip supporters 422 include second irregular portions 422*a* formed at outer surfaces facing the slide bars 427 such that the second irregular portions 422*a* are engaged with the first irregular portions 427*a*. The first irregular portions 427*a* include grip guide holes 427*b* formed as long holes using a lengthwise direction of the slide bars 427 as longer axis, into which the grip rotational shaft 423 is inserted.

Figure 12:
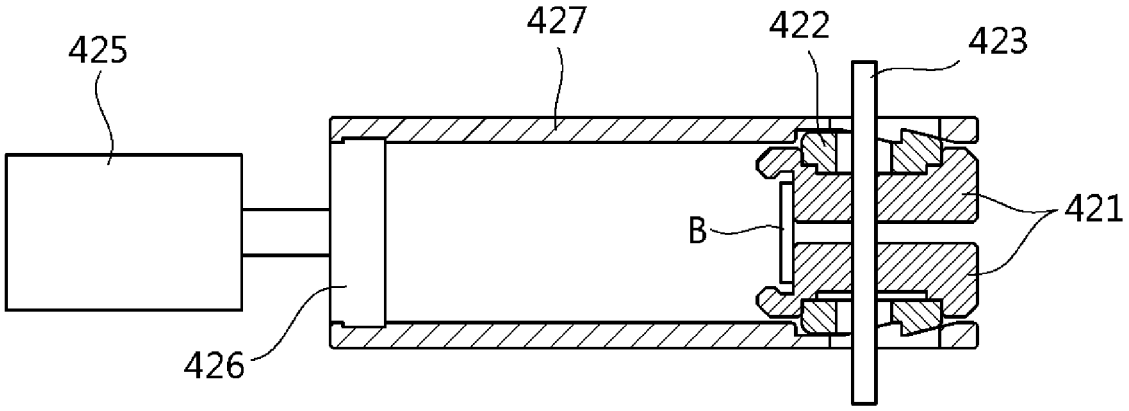
FIGS. 12 and 13 are operational views showing band gripping operations of the robot binding apparatus for coil packaging according to one embodiment of the present invention.
Figure 13:
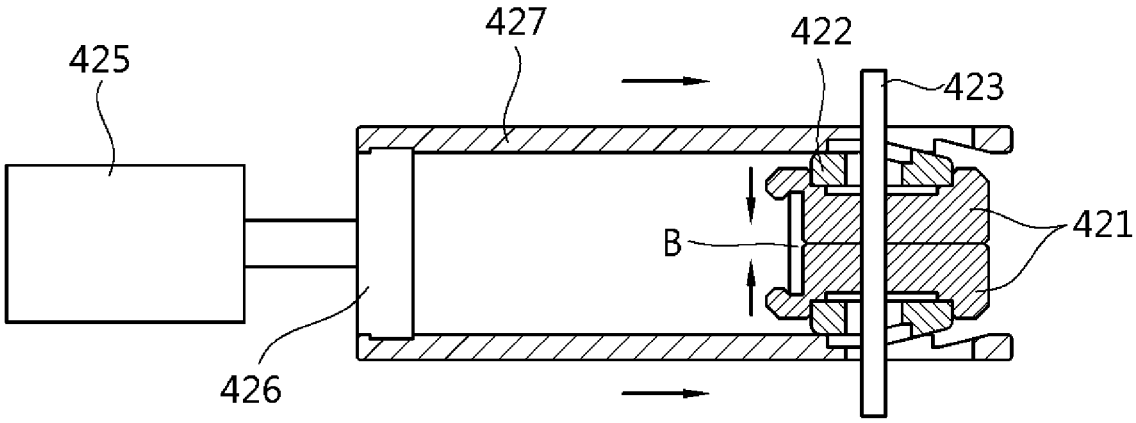

FIGS. 12 and 13 are operational views showing band gripping operations of the robot binding apparatus for coil packaging according to one embodiment of the present invention. With reference to FIGS. 12 and 13, with the first irregular portions 427*a* and the second irregular portions 422*a* engaged, the grip cylinder 425 advances the rod block 426 to make the pair of slide bars 427 move forward. At this time, the pair of slide bars 427 move forward, while being supported by the grip rotational shaft 423 positioned at the inner side of the grip guide holes 427*b*.

The pair of slide bars 427 come in contact with the outer circumferential surfaces of the pair of grippers 421. Namely, protruded portions of the first irregular portions 427*a* engaged with depressed portions of the second irregular portions 422*a* are slid to protruded portions of the second irregular portions 422*a*. Accordingly, the first irregular portions 427*a* press the pair of grip supporters 422, narrowing the space between the pair of grippers 421, whereby the pair of grippers 421 press the band (B) in the widthwise direction to grip the front end of the band (B).

With reference to FIGS. 10 and 11, the rotation controller 430 includes a driving cam 431 coupled with the grip rotational shaft 423, a cam link 432 hinge-combined with the driving cam 431, and a control ink 433 hinge-combined with the cam link 432. Further, the rotation controller 430 includes a support frame 434 fixed to an outer side of the grip frame 424 and a hook 435 hinge-combined with the support frame 434 and disposed at an upper portion of the control link 433.

Also, the rotation controller 430 includes a hooking state maintaining member 436 provided as an elastic member and having one end coupled with the hook 435 and the other end combined with the rod block 426, and a returning member 437 provided as an elastic member and having one end coupled with the control link 433 and the other end coupled with the grip frame 424.

Figure 14:
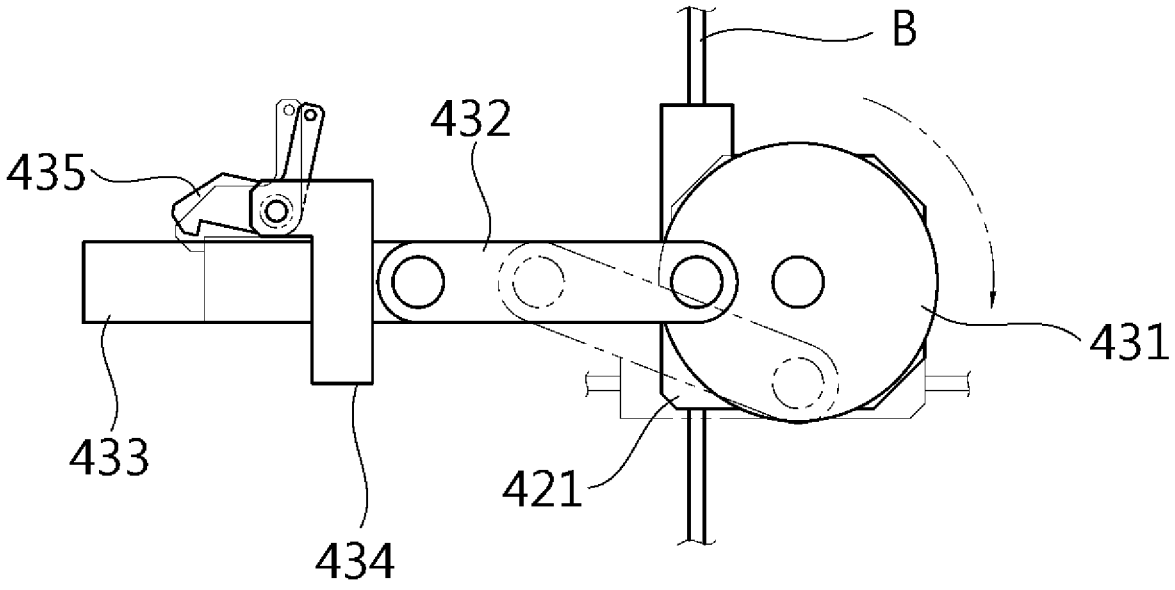
FIG. 14 is an operational view showing a gripper rotation controlling operation of a rotation controller of the grip unit of the robot binding apparatus for coil packaging according to one embodiment of the present invention.

FIG. 14 is an operational view showing a gripper rotation controlling operation of the rotation controller of the grip unit of the robot binding apparatus for coil packaging according to one embodiment of the present invention. With reference to FIG. 14, it is assumed that when the front end of the band (B) discharged out of the head unit 300 is gripped by the grippers 421, the position of the driving cam 431 is 0°. When the position of the driving cam 431 is 0°, the cam link 432 is maintained in a horizontal state. At this time, the hook 435 is positioned on the upper surface of the control link 433 and supported by the control link 433.

The grippers 421 are rotated according to a change in the posture of the grip unit 400 by the grip robot 401. At this time, when the position of the driving cam 431 reaches 270°, the cam link 432 is rotated downwardly. Then, the control link 433 is linearly moved toward the grippers 421. At this time, the hook 435 is rotated without being supported by the control link 433. The hook 435 is caught at an end portion of the control link 433, and the hooking state maintaining member 436 elastically supports the hook 435 to restrict the control link 433 from linearly moving to the opposite side of the grippers 421. In addition, the returning member 437 elastically supports the control link 433 so as to be maintained in its horizontal posture, so that a rotation angle of the cam link 432 cannot exceed 270°.

If the position of the driving cam 431 exceeds 270°, the cam link 432 is lifted again, and the cam link 432 connected to the control link 433 moves the control link 433 to the opposite side of the grippers 421. However, because the hook 435 is caught at the end portion of the control link 433, the grippers 421 to which the driving cam 431 is restrained by the control link 433 and the cam link 432 are not rotated any further.

The rotation controller 430 restricts the rotation angle of the grippers 421 within 270° to prevent the band (B) from entwined at the grippers 421.

Figure 15:
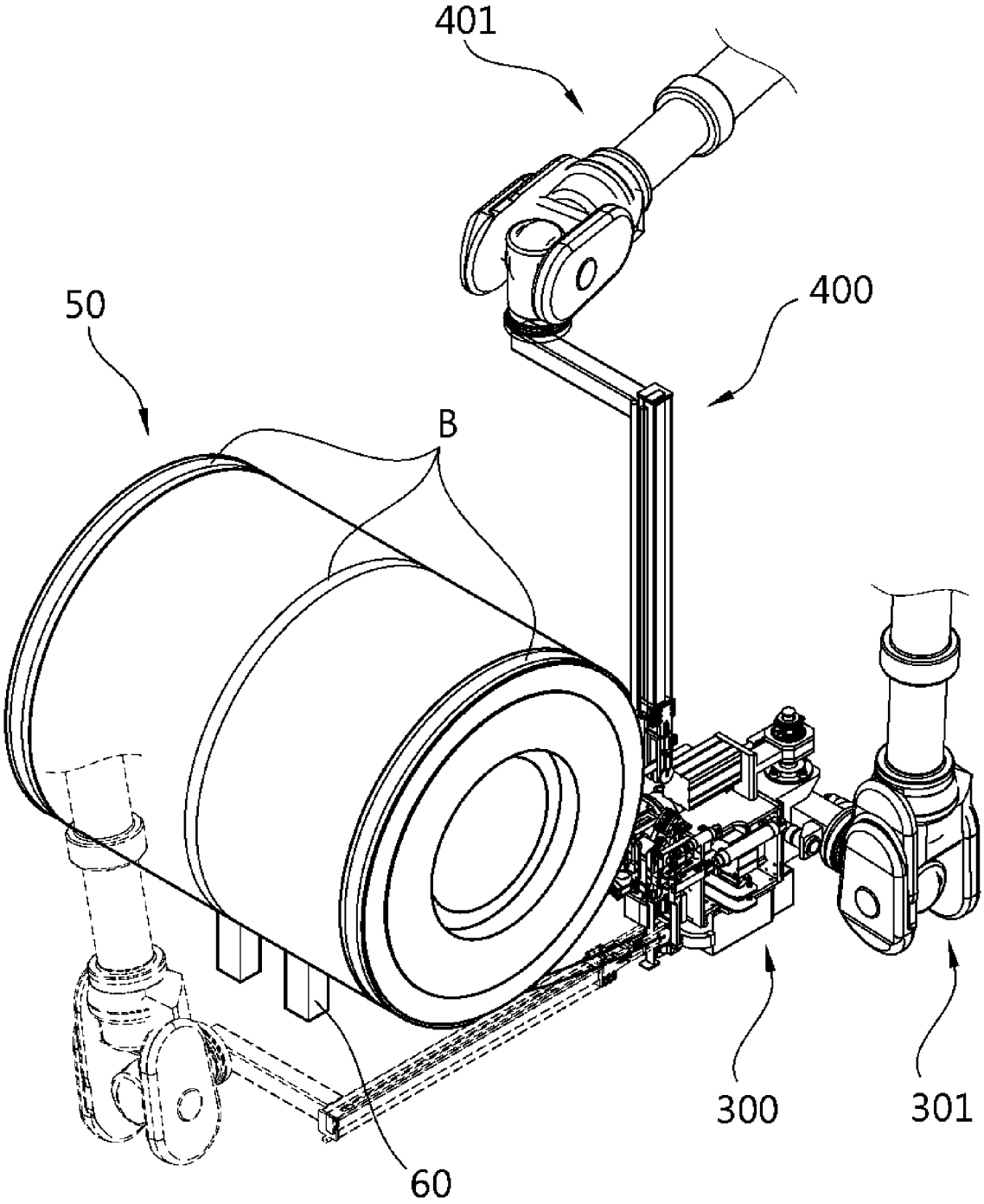
FIG. 15 is an operational view showing a vertical binding bending operation of the robot binding apparatus for coil packaging according to one embodiment of the present invention.

As shown in FIG. 15, the robot binding apparatus as described above vertically binds the band (B) on the coil 50 supported by the coil support 60. The vertical binding of the band (B) refers to winding the band (B) on the outer circumferential surface of the coil 50 and fastening the band (B).

Figure 16:
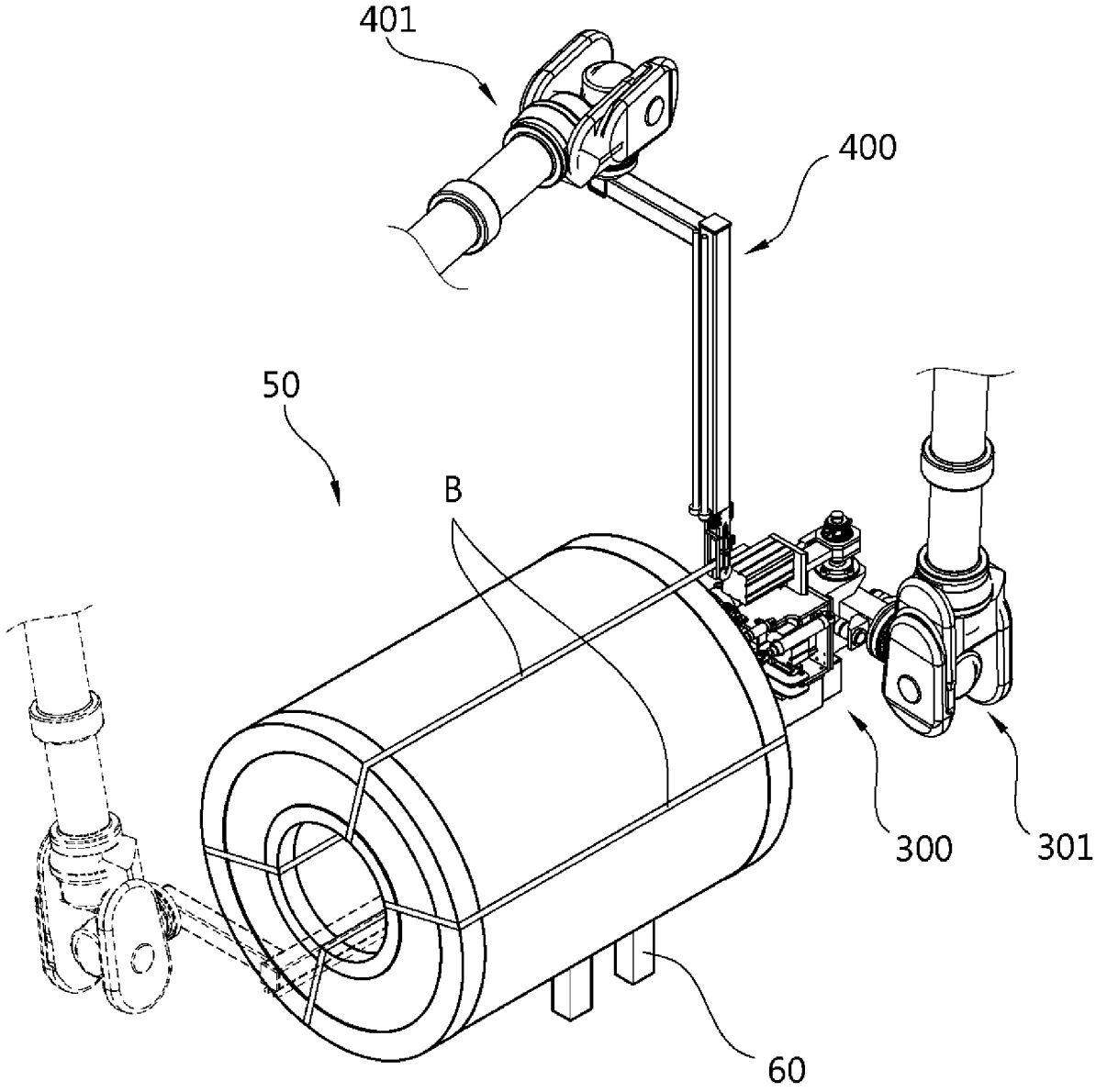
FIG. 16 is an operational view showing a horizontal binding bending operation of the robot binding apparatus for coil packaging according to one embodiment of the present invention.

In addition, as shown in FIG. 16, the robot binding apparatus horizontally binds the band (B) on the coil supported by the coil support 60. The horizontal binding of the band (B) refers to winding the band (B) on the outer circumferential surface by passing it through the inner circumferential surface of the coil 50, and fastening the band (B).

Figure 17:
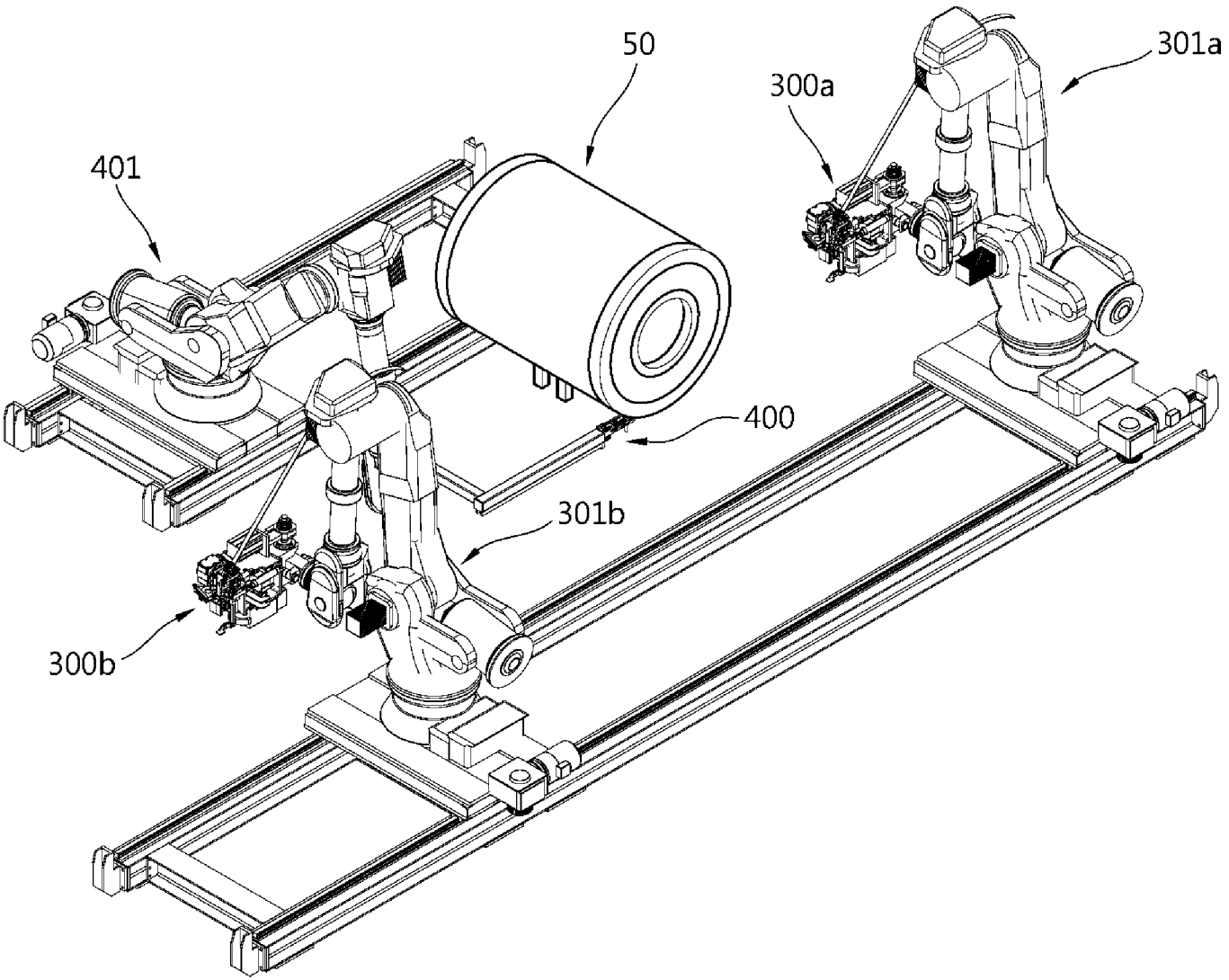
FIG. 17 is a perspective view showing the robot binding apparatus for coil packaging according to one embodiment of the present invention.

In the above description, the case where the robot binding apparatus performs binding process on the coil 50 whose central axis is supported to be horizontal to the ground is taken as an example. However, as shown in FIG. 17, the robot binding apparatus can also bind the band (B) on the coil 50 whose central axis is supported to be perpendicular to the ground.

Figure 18:
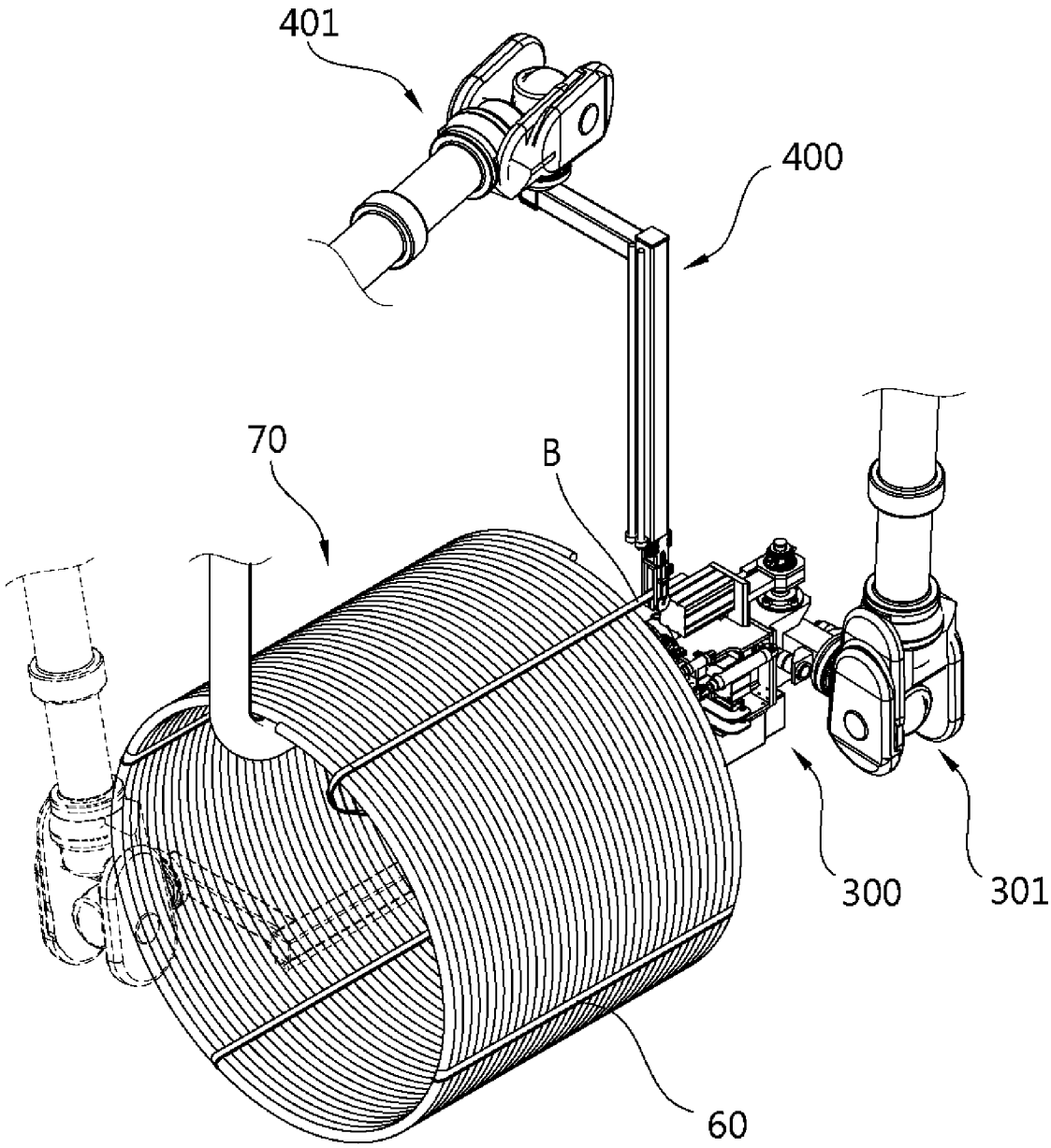
FIG. 18 is a perspective view showing an operation of binding a wire coil by using the robot binding apparatus for coil packaging according to one embodiment of the present invention.

In addition, FIGS. 1 to 17 illustrate the robot binding apparatus for binding the coil 50 which is manufactured as a platy member and packaged. However, as shown in FIG. 18, the robot binding apparatus may also bind a coil 70 which is manufactured as a wire rod and packaged.

Figure 19:
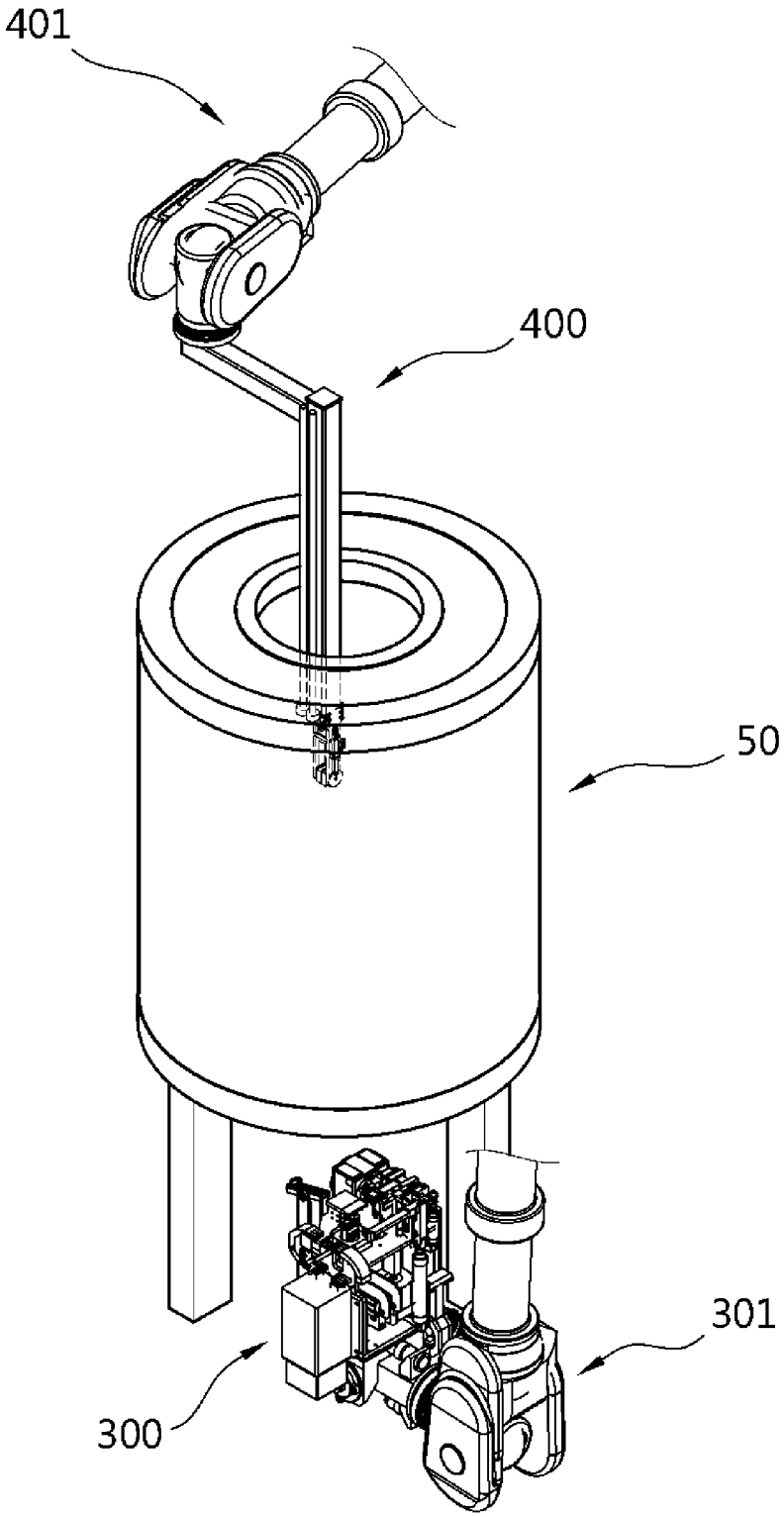
FIG. 19 is a perspective view showing the robot binding apparatus for coil packaging according to another embodiment of the present invention.

With reference to FIG. 19, the robot binding apparatus may include a plurality of head units 300*a* and 300*b* and a plurality of head robots 301*a* and 301*b* to perform the coil binding process according to the types of bands (B).

Figure 20:
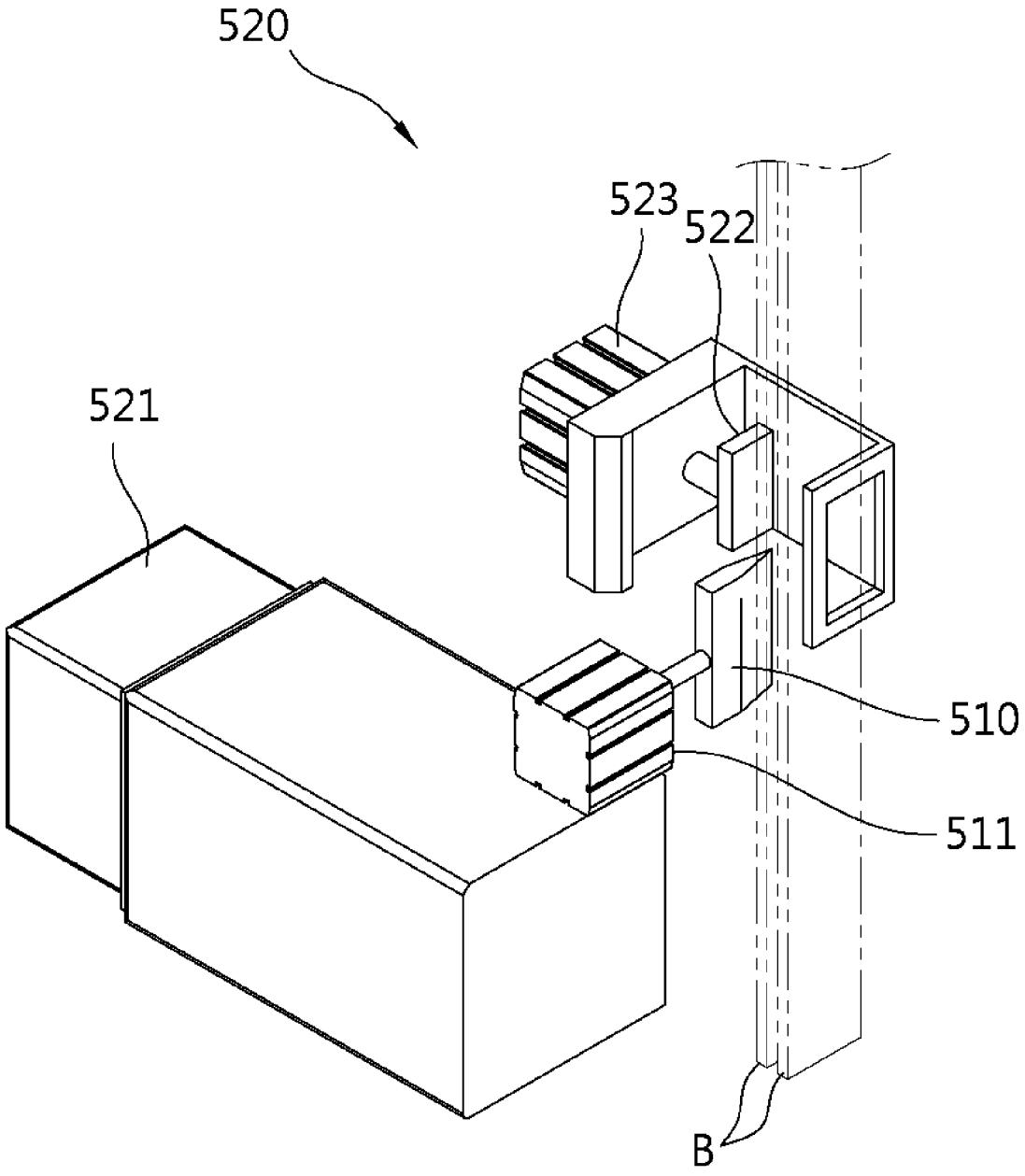
FIG. 20 is a perspective view showing a portion of a band fastening unit of the robot binding apparatus for coil packaging according to another embodiment of the present invention.

FIG. 20 is a perspective view showing a portion of the band fastening unit of the robot binding apparatus for coil packaging according to another embodiment of the present invention. With reference to FIG. 20, if a band (B) made of thermoplastic synthetic resin material is supplied, a band fastening unit 520 includes a heating bar 510 disposed at one side of overlapping bands (B), a heating cylinder 511 that transfers the heating bar 510, a pressing bar 522 disposed at an inner side of the overlapping bands (B), and a pressing cylinder 523 that transfers the pressing bar 522 to an outer side of the overlapping bands (B).

The heating bar 510 is heated upon receiving power from a power supplier 521. The heating cylinder 511 transfers the heating bar 510 to between the overlapping bands (B). Because the heated heating bar 510 is transferred to between the overlapping bands (B), the overlapping bands (B) are molten, and the pressing bar 522 is transferred to the outer side of the overlapping bands (B) by the pressing cylinder 523. At this time, because the outer side of the overlapping bands (B) is supported by the rear surface of the support panel 324, the overlapping bands (b) are compressed and fastened.

The preferred embodiments of the present invention have been described with reference to the accompanying drawings, and it will be apparent to those skilled in the art that various modifications and variations can be made in the present invention without departing from the scope of the invention. Thus, it is intended that any future modifications of the embodiments of the present invention will come within the scope of the appended claims and their equivalents.

What is claimed is:

1. A robot binding apparatus for coil packaging, comprising:

a grip unit that grips a band used for packaging a coil;

a grip robot that supports the grip unit, rotates the grip unit seizing the band at the periphery of the coil to insert the band through the inner circumferential surface of the coil and to make the band wound on the coil, and moves the band to a fastening position;

a head unit that provides the band to the grip unit and fastens the band at the band fastening position; and a head robot that supports the head unit and moves the head unit to the band fastening position.

2. The apparatus of claim 1, further comprising:

a robot transfer unit that supports at least one of the head robot and the grip robot and moves the position of the supported robot.

3. The apparatus of claim 2, wherein the robot transfer unit comprises:

a first robot transfer unit that supports the head unit and transfers the head robot; and a second robot transfer unit that supports the grip unit and transfers the grip robot.

4. The apparatus of claim 2, wherein the robot transfer unit linearly transfers the supported robot.

5. The apparatus of claim 2, wherein the robot transfer unit comprises one of a linear actuator comprised of a power motor and a rack/pinion, a linear actuator comprised of a linear motion (LM) motor and an LM guide, and a linear actuator comprised of a power motor, a transfer rail, and a ball screw.

6. The apparatus of claim 1, wherein the head unit and the grip robot are joint type robots having the degree of freedom of six axes.

7. The apparatus of claim 1, further comprising:

a band supplier that supplies the band to the head unit.

8. The apparatus of claim 7, wherein the band supplier comprises:

a band storage unit that holds the band wound thereon; and a band auxiliary withdrawal unit disposed at a path of the band supplied from the band storage unit to the head unit, and reducing tension of the band by withdrawing the band from the band storage unit.

9. The apparatus of claim 1, wherein a plurality of head units are provided according to the types of the bands.

10. The apparatus of claim 1, wherein the head unit comprises:

a bracket fastened to the head robot such that the bracket is rotatable; and a band transfer unit allowing the band to pass thereinto by being supported by the bracket, discharging a front end of the band, and transferring the band wound on the coil thereinto so that the bands can overlap each other.

11. The apparatus of claim 10, wherein the band transfer unit rewinds the band wound on the coil.

12. The apparatus of claim 10, wherein the head unit further comprises a band cutting unit that cuts off a portion next to a fastened portion of the bands.

13. The apparatus of claim 1, wherein the grip unit comprises:

an elastic part fastened to the grip robot such that the elastic part is rotatable, and extending or contracting the overall length; and a grip part supported by the elastic part and gripping the band by pressing the band in a widthwise direction.

14. The apparatus of claim 1, further comprising:

a coil support supporting the coil such that a central axis of the coil is horizontal to the ground.

15. The apparatus of claim 1, further comprising:

a coil support supporting the coil such that the central axis of the coil is perpendicular to the ground.

* * * * *